US006854005B2

(12) United States Patent
Thiele

(10) Patent No.: US 6,854,005 B2
(45) Date of Patent: Feb. 8, 2005

(54) CROSSOVER FILTER SYSTEM AND METHOD

(75) Inventor: Albert Neville Thiele, Epping (AU)

(73) Assignee: Techstream Pty Ltd., Victoria (AU)

( * ) Notice: Subject to any disclaimer, the term of this patent is extended or adjusted under 35 U.S.C. 154(b) by 202 days.

(21) Appl. No.: 10/077,992

(22) Filed: Feb. 20, 2002

(65) Prior Publication Data

US 2003/0002694 A1 Jan. 2, 2003

Related U.S. Application Data

(63) Continuation of application No. PCT/AU00/01036, filed on Sep. 1, 2000.

(30) Foreign Application Priority Data

Sep. 3, 1999 (AU) ..... PQ2608

(51) Int. Cl.[7] ..... G06G 7/02
(52) U.S. Cl. ..... 708/819; 381/99
(58) Field of Search ..... 708/819, 300; 381/99

(56) References Cited

U.S. PATENT DOCUMENTS 3,657,480 A 4/1972 Cheng et al.
4,031,321 A 6/1977 Bakgaard
4,589,135 A 5/1986 Baker
4,771,466 A * 9/1988 Modafferi ..... 381/99
5,568,560 A 10/1996 Combest
5,937,072 A 8/1999 Combest
6,405,227 B1 * 6/2002 Prakash ..... 708/300

OTHER PUBLICATIONS

A.N. Thiele, "Optimum Passive Loudspeaker Dividing Networks", Proceedings of the IREE, Jul. 1975, pp. 22–224.
Siegfried H. Linkwitz, "Active Crossover Networks for Noncoincident Drivers", Journal of the Audio Engineering Society, Hewlett–Packard Company, Santa Rosa, California, pp. 381–387.
Sallen, et al., "A Practical Method of Designing RC Active Filters", IRE Transactions–Circuit Theory, Mar. 1955, pp. 74–85.

(List continued on next page.)

*Primary Examiner*—Tan V. Mai
(74) *Attorney, Agent, or Firm*—Birch, Stewart, Kolasch & Birch, LLP

(57) ABSTRACT

A filter system including a low pass filter having a response which rolls off towards a crossover frequency and a high pass filter having a complementary response which rolls off towards the crossover frequency. The responses are arranged such that the combined response of the filters is substantially constant in amplitude at least in the region of the crossover frequency. The response of the low pass filter is defined by a low pass complex transfer function having a first numerator and a first denominator. The response of the high pass filter is defined by a high pass complex transfer function having a second numerator and a second denominator. The desired response is obtained when the second denominator is substantially the same as the first denominator and the sum of the first and second numerators has substantially the same squared modulus as the first or second denominator.

34 Claims, 13 Drawing Sheets

OTHER PUBLICATIONS

Shorter, et al., "A Survey of Performance Criteria and Design Considerations for High–Quality Monitoring Loudspeakers", Journal of the Audio Engineering Society, pp. 56–71.

Siegfried H. Linkwitz, "Passive Crossover Networks for Noncoincident Drivers", Engineering Reports, Mar. 1978, vol. 26, No. 3, pp. 149–150.

A.N. Thiele, "An Air–Cored Auto–Transformer with Nearly–Equal Decibel Taps", JAES, Dec. 2000, pp. 1–37.

"Precise active x–over", Electronics World, Aug. 1999, pp. 652–655 and 691–693.

A.N. Thiele, "Loudspeakers, Enclosures and Equalisers", Proceedings of the IREE, Nov. 1973, pp. 425–448.

* cited by examiner

CROSSOVER FILTER SYSTEM AND METHOD

This application is a Continuation of copending PCT International Application No. PCT/AU00/01036 filed on Sep. 1, 2000, which was published in English and which designated the United States and on which priority is claimed under 35 U.S.C. § 120, the entire contents of which are hereby incorporated by reference.

BACKGROUND OF THE INVENTION

The present invention relates to crossover filters suitable for dividing wave propagated phenomena or signals into at least two frequency bands.

The phenomena/signals are to be divided with the intention that recombination of the phenomena/signals can be performed without corrupting amplitude integrity of the original phenomena/signals.

The present invention will hereinafter be described with particular reference to filters in the electrical domain. However, it is to be appreciated that it is not thereby limited to that domain. The principles of the present invention have universal applicability and in other domains, including the electromagnetic, optical, mechanical and acoustical domains. Examples of the invention in other domains are given in the specification to illustrate the universal applicability of the present invention.

Crossover filters are commonly used in loudspeakers which incorporate multiple electroacoustic transducers. Because the electroacoustic transducers are designed or dedicated for optimum performance over a limited range of frequencies, the crossover filters act as a splitter that divides the driving signal into at least two frequency bands.

The frequency bands may correspond to the dedicated frequencies of the transducers. What is desired of the crossover filters is that the divided frequency bands may be recombined through the transducers to provide a substantially accurate representation (ie. amplitude and phase) of the original driving signal before it was divided into two (or more) frequency bands.

Common shortcomings of prior art crossover filters include an inability to achieve a recombined amplitude response which is flat or constant across the one or more crossover frequencies and/or an inability to roll off the response to each electroacoustic transducer quickly enough, particularly at the low frequency side of the crossover frequency. Rapid roll off is desirable to avoid out of band signals introducing distortion or causing damage to electroacoustic transducers. Prior art designs achieve rapid roll off by utilizing more poles in the filter design since each pole contributes 6 dB per octave additional roll off. However a disadvantage of this approach is that it increases group delay. An object of the present invention is to alleviate the disadvantages of the prior art.

SUMMARY OF THE INVENTION

The present invention proposes a new class of crossover filters suitable for, inter alia, crossing over between pairs of loudspeaker transducers. The crossover filters of the present invention may include a pair of filters such as a high pass and a low pass filter. Each filter may have an amplitude response that may include a notch or null response at a frequency close to or in the region of the crossover frequency. A notch or null response above the crossover frequency in the low pass filter and below the crossover frequency in the high pass filter may provide a greatly increased or steeper roll off for each filter of the crossover for any order of filter. Notwithstanding the notch or null response the amplitude responses of the pair of filters may be arranged to add together to produce a combined output that is substantially flat or constant in amplitude at least across the region of the crossover frequency. Benefits of such an arrangement include improved amplitude response and improved out of band signal attenuation close to the crossover frequency for each band.

It may be shown that the transfer function of the summed output of nth order crossover filters wherein each filter incorporates a second order notch is $$F(sT_x)_{\sum n} = \frac{\overset{\text{LOW-PASS}}{(1+k^2s^2T_x^2)} \pm \overset{\text{HIGH-PASS}}{s^{n-2}T_x^{n-2}\,(k^2+s^2T_x^2)}}{F_{DENn}(sT_x)} \tag{1}$$

where k is the ratio of lower notch frequency $f_{NL}$ in the high-pass response to the crossover or transition frequency $f_X$ $$k=f_{NL}/f_X=f_X/f_{NH} \tag{2}$$

and where $f_{NH}$ is the higher notch frequency in the low-pass response, and $T_X$ is the associated time constant of the crossover frequency ($T_X=\frac{1}{2}\pi f_X$). The present invention is applicable to notches of higher order but second order notches are sufficient to illustrate the principle.

The common denominator $F_{DENn}$ ($sT_X$) is derived from the numerator of the summed response by factorising it into first and second order factors, changing the signs of any negative first order terms in those factors to positive and then re-multiplying all the factors together. The summed response thus becomes an all-pass function whose numerator is the product of all the factors of the original numerator with negative first order terms.

According to one aspect of the present invention there is provided an improved filter system including a low pass filter having a response which rolls off towards a crossover frequency and a high pass filter having a complementary response which rolls off towards said crossover frequency such that the combined response of said filters is substantially constant in amplitude at least in the region of said crossover frequency, wherein said response of said low pass filter is defined by a low pass complex transfer function having a first numerator and a first denominator and said response of said high pass filter is defined by a high pass complex transfer function having a second numerator and a second denominator and wherein said second denominator is substantially the same as said first denominator and the sum of said first and second numerators has substantially the same squared modulus as said first or second denominator.

The low pass filter may include a first null response at a frequency in the region of and above the crossover frequency. The first null response may be provided by at least one complex conjugate pair of transmission zeros such that their imaginary parts lie in the stop band of the low pass transfer function within the crossover region. The high pass filter may include a second null response at a frequency in the region of and below the crossover frequency. The second null response may be provided by at least one complex conjugate pair of transmission zeros such that their imaginary parts lie in the stop band of the high pass transfer function within the crossover region.

According to a further aspect of the present invention there is provided a method of tuning a filter system including a low pass filter having a response which rolls off towards a crossover frequency and a high pass filter having a complementary response which rolls off towards said crossover frequency such that the combined response of said filters is substantially constant in amplitude at least in the region of said crossover frequency, said method including the steps of: selecting a filter topology capable of realizing a low pass complex transfer function defined by a first numerator and a first denominator; selecting a filter topology capable of realizing a high pass complex transfer function defined by a second numerator and a second denominator; setting the second denominator so that it is substantially the same as the first denominator; and setting the squared modulus of the sum of the first and second numerators so that it is substantially the same as the squared modulus of the first or second denominator.

The method may include the step of determining coefficients for the transfer functions and the step of converting the coefficients to values of components in the filter topologies.

The invention may be realised via networks of any desired order depending upon the desired rate of rolloff for the resultant crossover. The invention may be realised using passive, active or digital circuitry or combinations thereof as is known in the art. Combinations may include but are not limited to an active low pass and passive high pass filter pair of any desired order, digital low pass and active high pass filter of any desired order, passive low pass and passive high pass filter of any desired order, digital low pass and digital high pass filter of any desired order, and active low pass and digital high pass filter realisations.

The invention may be further realised wherein the filter response is produced with a combination of electrical and mechano-acoustic filtering as may be the case where the electroacoustic transducer and/or the associated acoustic enclosure realise part of the filter response.

DESCRIPTION OF THE DRAWINGS

Preferred embodiments of the present invention will now be described with reference to the accompanying drawings wherein:

FIG. 12(*b*) shows a passive fourth-order high-pass filter (first kind) with components transformed $CnH=T_X^2/LnL$ & $LnH=T_X^2/CnL$ from FIG. 12(*a*);

FIG. 12(*c*) shows a passive fourth-order high-pass filter (first kind) with inductances the result of Δ-Y transformation from FIG. 12(*b*);

FIG. 12(*d*) shows a passive fourth-order high-pass filter (first kind) with inductances of FIG. 12(*c*) realised as a coupled pair (series opposing);

FIG. 13(*b*) shows a passive fourth-order low-pass filter (second kind) with inductances of FIG. 13(*a*) realised as a coupled pair (series opposing);

FIG. 13(*c*) shows a passive fourth-order high-pass filter (second kind);

FIG. 13(*d*) shows a passive fourth-order high-pass filter (second kind);

DESCRIPTION OF PREFERRED EMBODIMENTS

Figure 1:
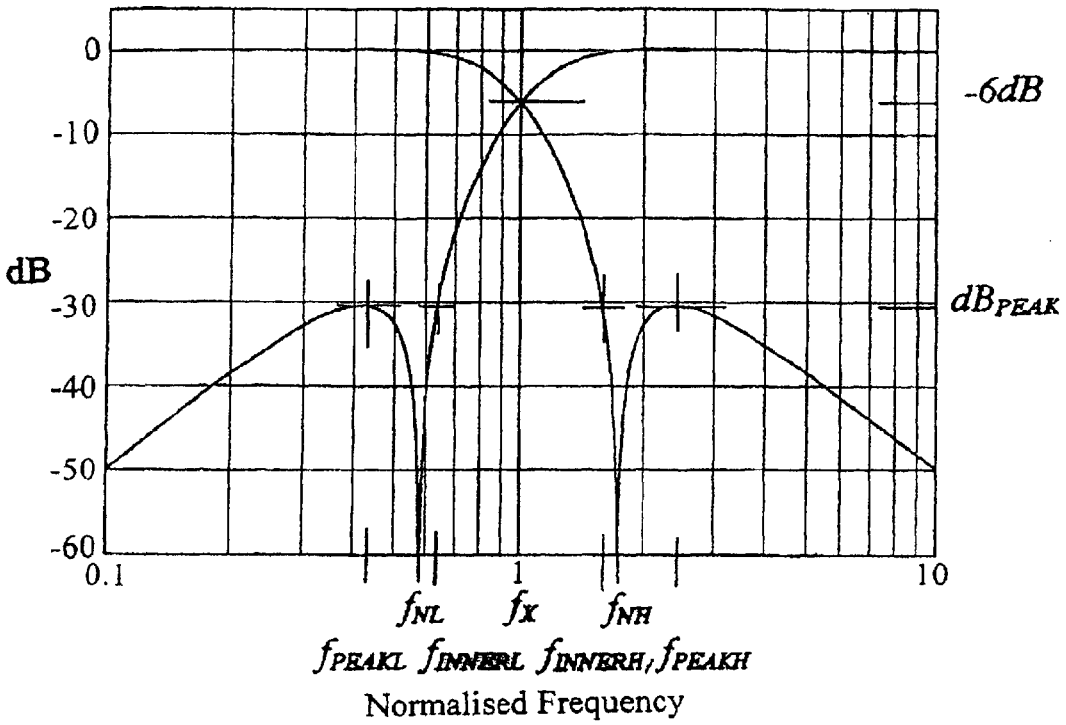
FIG. 1 shows generalised responses of even order notched high-pass and low-pass filters.

The generalised responses of even-order notched crossovers are shown in FIG. 1. $F_{NL}$ is the lower null centre frequency for the high pass filter, $F_{NH}$ is the upper null centre frequency for the low pass filter, $F_{PEAKH}$ is the upper peak frequency for the low pass filter, $F_{INNERL}$ is the highest frequency at which the output of the high pass filter equals the peak value below the null for the high pass filter, $F_{INNERH}$ is the lowest frequency at which the output of the low pass filter equals the peak value above the null for the low pass filter and $F_X$ is the crossover or transition frequency. The in-band response of each filter rises at first to a small peak at the frequency of the out-of-band peak of the other filter. It then falls back to reference 0 dB level at the other filter's notch frequency, and onwards to −6.0 dB at the transition frequency $f_X$.

The response falls to a null at its $f_N$, then rises to $dB_{PEAK}$ at $f_{PEAK}$ before falling away again at extreme frequencies at a rate, for an nth order filter, of 6(n−2) dB per octave. The effective limit of its response is at $f_{INNER}$ where it has first passed through $dB_{PEAK}$.

Figure 2:
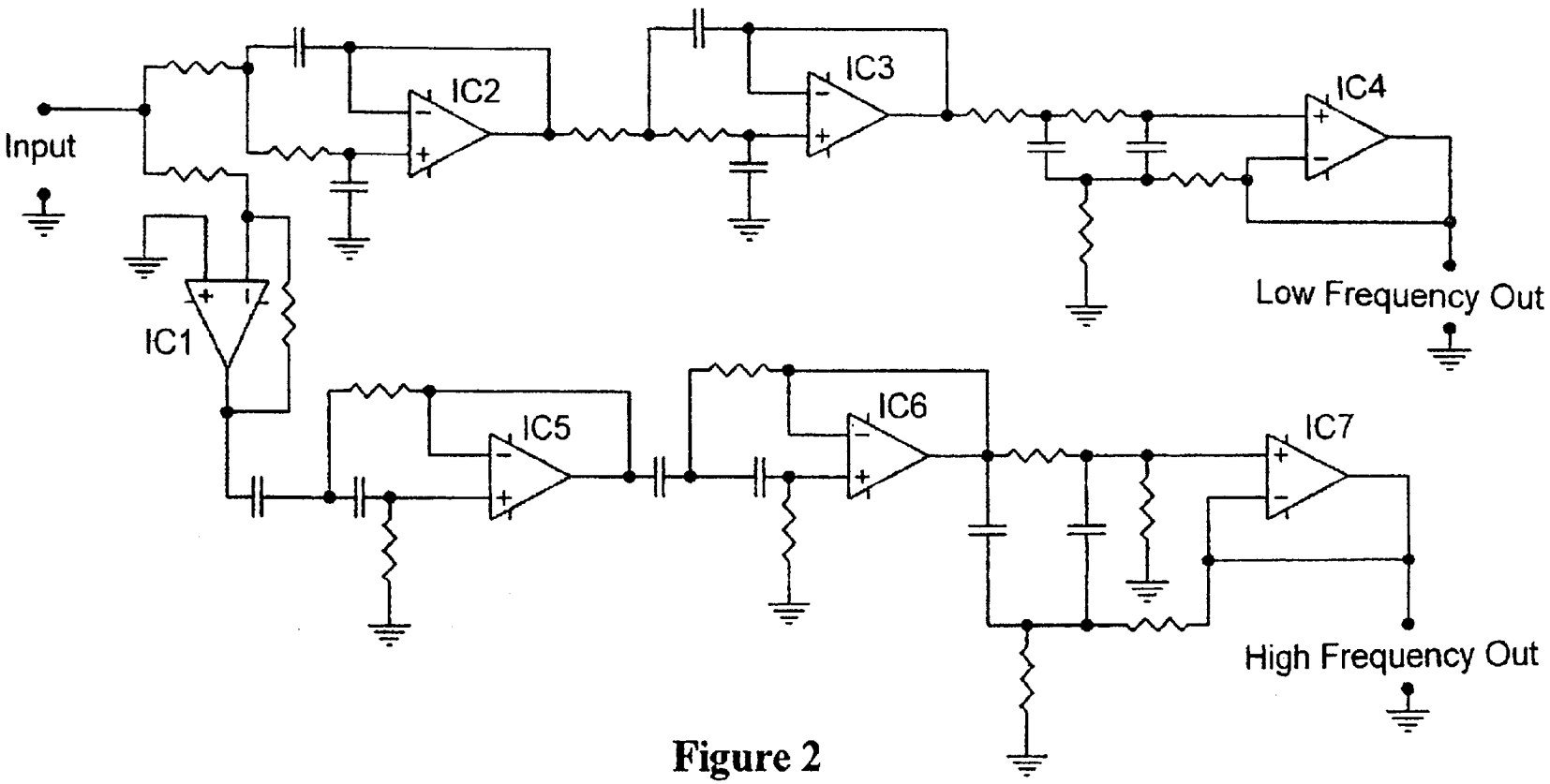
FIG. 2 shows a schematic circuit diagram for sixth order active high pass and low pass filters.
Figure 3A:
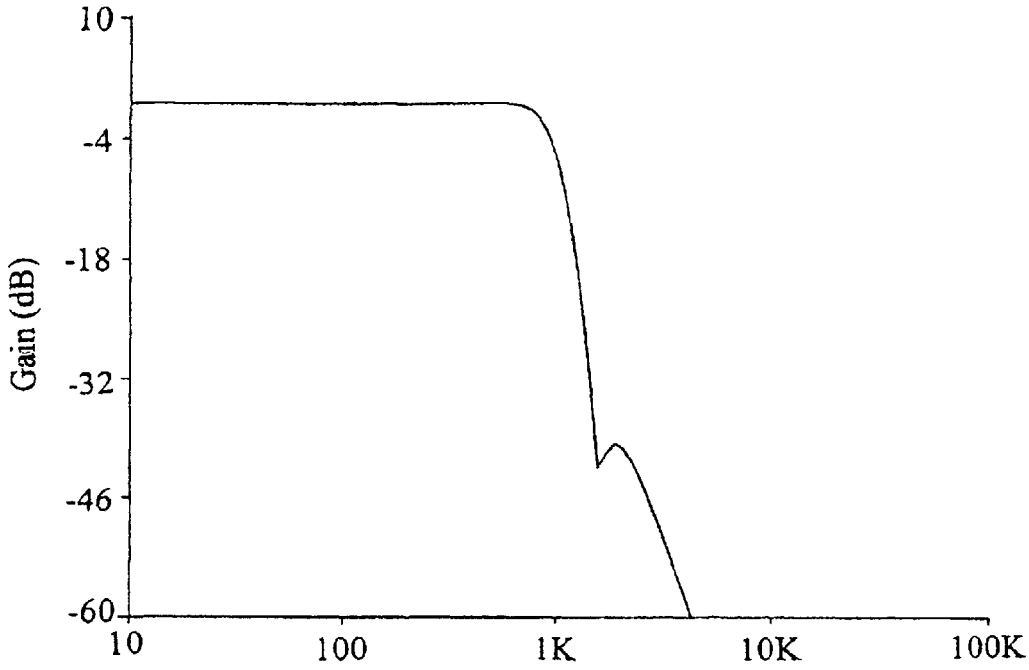
FIG. 3*a* shows the amplitude response for the low pass filter in FIG. 2.
Figure 3B:
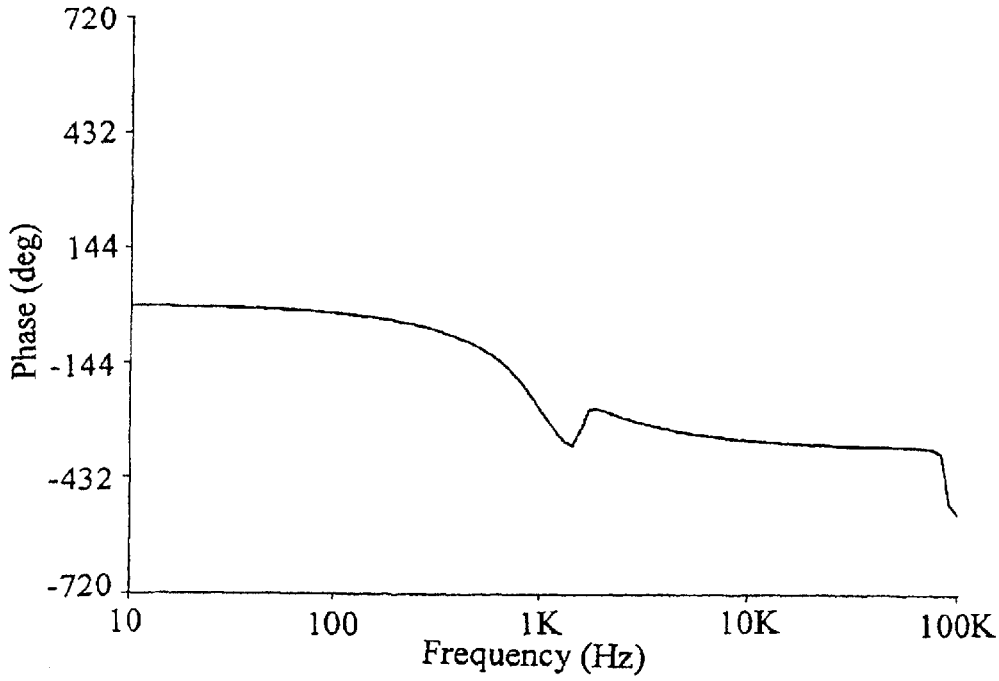
FIG. 3*b* shows the phase response for the low pass filter in FIG. 2.
Figures 4A, 4B:
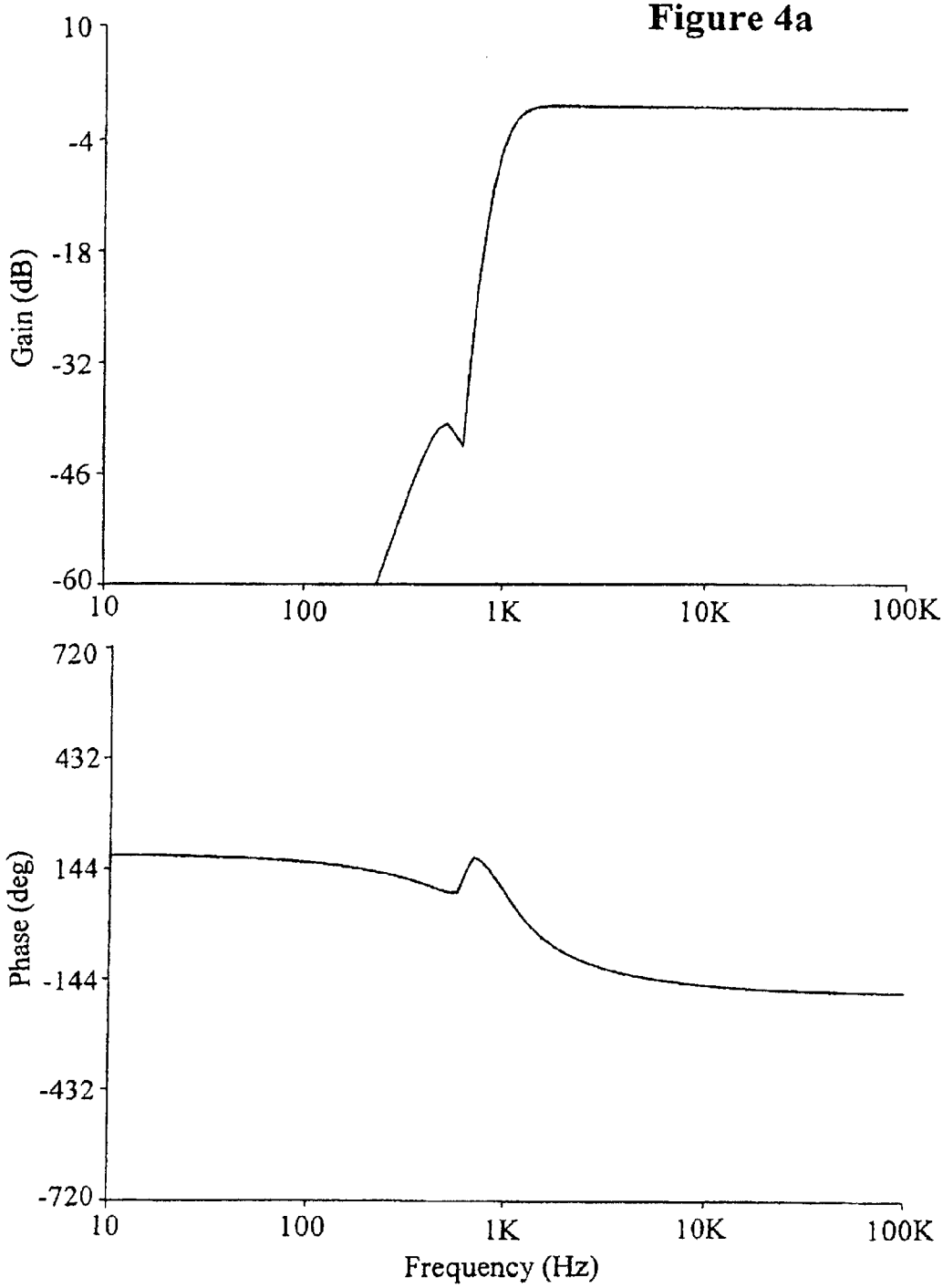
FIG. 4*a* shows the amplitude response for the high pass filter in FIG. 2.
FIG. 4*b* shows the phase response for the high pass filter in FIG. 2.
Figures 5A, 5B:
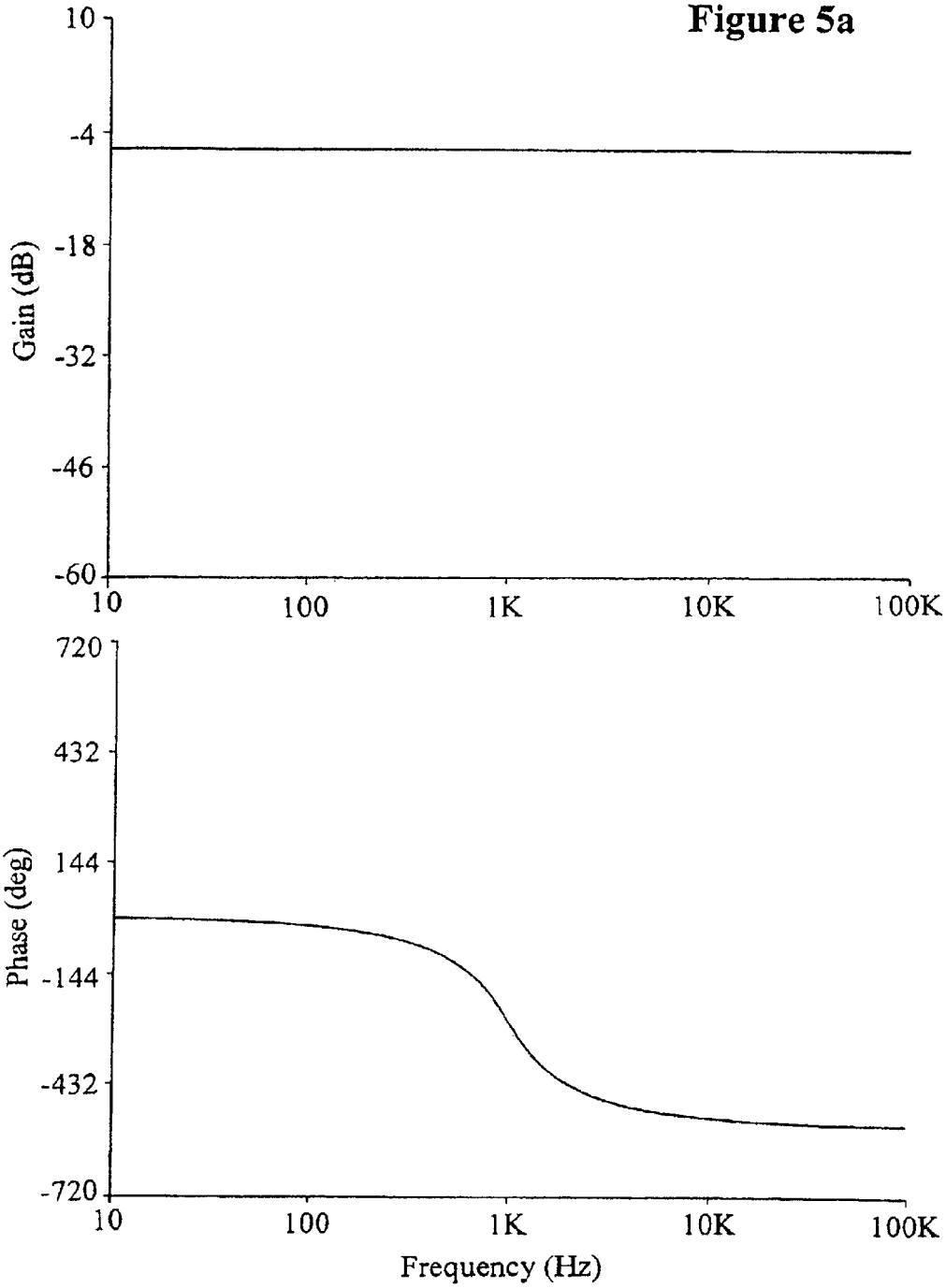
FIG. 5*a* shows the summed amplitude response for the low and high filters in FIG. 2.
FIG. 5*b* shows the summed phase response for the low and high pass filter in FIG. 2.

FIG. 2 shows the schematic circuit diagram for a sixth order active circuit embodiment of the invention. In this figure the low pass filter includes IC2, IC3 and IC4 and the high pass filter includes IC5, IC6 and IC7. An inverter, IC1 is provided between the low and high pass filters to correct phase for the signals. IC3 and associated network generate the required second order filter transfer function for the low pass filter and IC2 and associated network generate two single order cascaded section responses as required. IC4 realises the notch in the low pass filter utilising Sallen & Key topology as known in the art. IC7 realises the notch in the high pass filter also utilising Sallen & Key topology as known in the art. IC6 and associated network generate the required second order filter transfer function for the high pass filter and IC5 and associated network generate two single order cascaded section responses as required. The filter sections use Sallen & Key topology as known in the art. The outputs of IC4 and IC7 provide signals to the low and high frequency electroacoustic transducers respectively. Inspection of signals in this network will reveal the response curves shown in FIGS. 3, 4 and 5.

Figure 6:
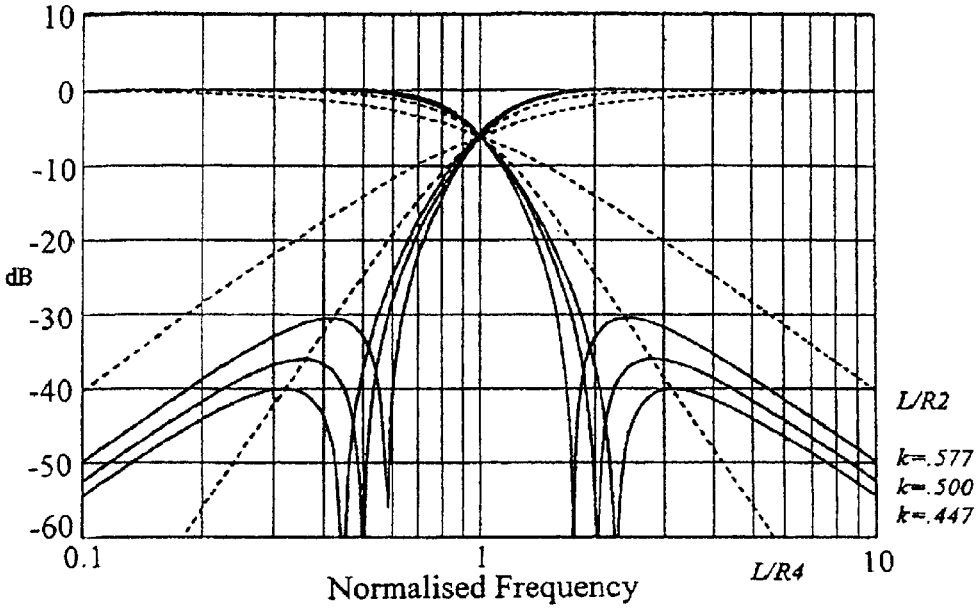
FIG. 6 shows responses of fourth order notched high-pass and low-pass filters.

The solid curves of FIG. 6 are for notched responses with $k^2$ figures of ⅓, ¼ and ⅕. The dashed curves, for comparison, are for Linkwitz-Riley responses of second order (upper) and fourth order (lower), with the same crossover frequency. In all cases, the notched response first reaches the level of $dB_{PEAK}$ at $f_{INNER}$, while the Linkwitz-Riley response reaches it near $f_{PEAK}$, which is more than 1.5 times (0.6 octave) further away.

Beyond the notches, the fourth order responses eventually run parallel to the second order Linkwitz-Riley response, but $k^2$ times lower, i.e. by 9.5 dB, 12.0 dB or 14.0 dB.

Figure 7:
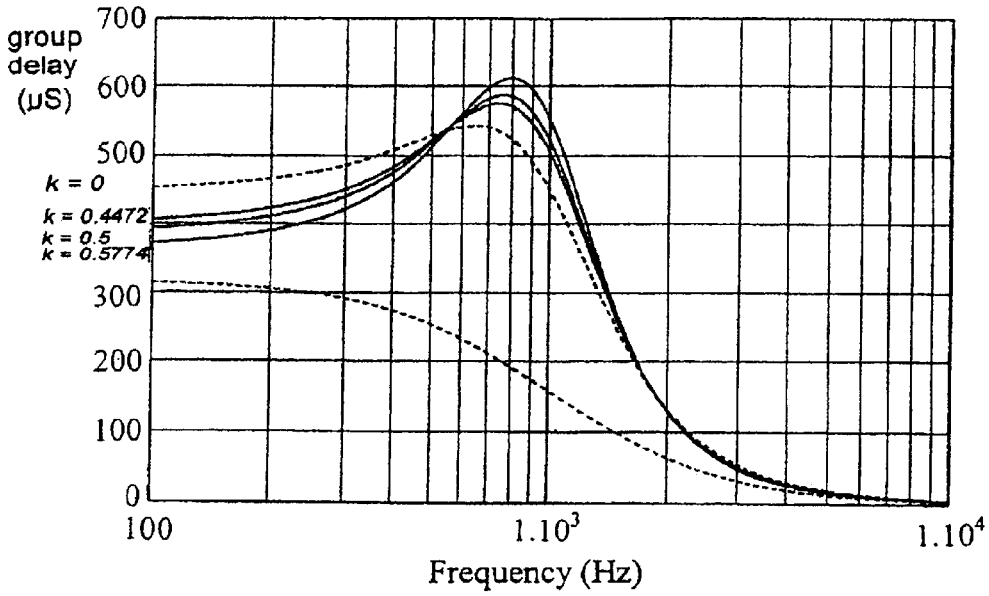
FIG. 7 shows group delay responses for filters crossing over at 1 kHz.

In FIG. 7, the solid curves of group delay for the same notched responses are compared with the dashed curves for Linkwitz-Riley responses of fourth order (upper) and second order (lower). The curves are for a crossover frequency of 1 kHz. For other crossover frequencies, the frequencies can be scaled in proportion, while the group delays are scaled in inverse proportion to the crossover frequency. The curves apply equally to low-pass, high-pass and summed outputs.

The transfer functions of the low-pass, high-pass and summed outputs of these even-order crossovers have numerators whose terms are all of even order. Thus they make no contribution to the group delay, and since all have the same denominator, the one curve of group delay applies to all.

Figure 8:
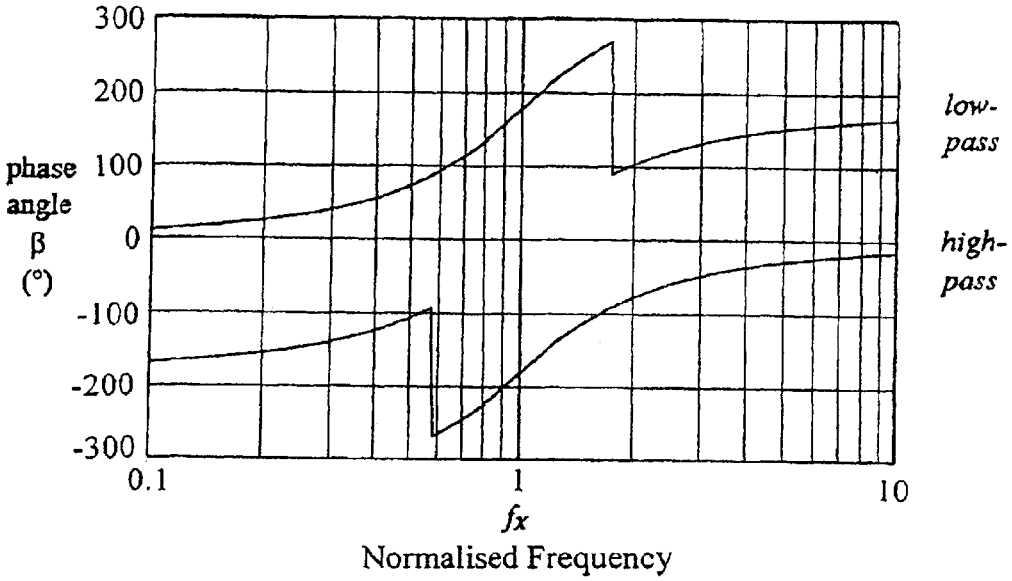
FIG. 8 shows phase responses of fourth order (k=0.5774) low-pass (upper) and high-pass (lower) filters.

In FIG. 8, the curves of phase difference between input and output for the low-pass and high-pass filters are parallel at all frequencies. They are a constant 360° apart at all frequencies between the notches and 180° apart at all frequencies beyond.

The results presented in FIGS. 6, 7 & 8 for fourth order notched responses with $k^2$=⅓ may be taken as generally typical of other even order notched responses with different values of $k^2$.

The responses of the odd-order functions are similar to those of even order, except that, because the individual high- and low-pass outputs combine in quadrature, each is now down to −3.0 dB, instead of −6.0 dB, at the crossover frequency $f_X$. The individual outputs now have a constant phase difference of 90° at frequencies between the two notches. At frequencies beyond, the inversion of polarity leaves the two outputs to still add in quadrature. Thus the in-band responses now fall initially, by less than 0.01 dB, before rising to reference level and then falling again to the stop band, in the manner of odd order elliptic function filters.

It turns out, not surprisingly, that when k is zero, so that the notch frequencies move outwards to zero and infinite frequencies, the transfer functions degenerate into Butterworths for odd order functions and double Butterworths [A. N. Thiele—*Optimum passive loudspeaker dividing networks—Proc. IREE Aust*, Vol 36, No 7, July 1975, pp. 220–224] (i.e. Linkwitz-Rileys [S. H. Linkwitz—*Active crossover networks for non-coincident drivers—JAES*. Vo. 24. No.1, January/February 1976, pp.2–8 and in *Audio Engineering Society*, Inc, New York, October 1978, pp. 367–373]) for the even order functions.

The group delay responses are similar to the "parent" response of the same order, with a somewhat lower insertion delay at low frequencies and a somewhat higher peak delay at a frequency below the transition $f_X$, as can be seen in Tables 1, 2 and 3 and FIG. 7, before diminishing towards zero at very high frequencies. This will become clearer from examining specific examples.

Even-Order Responses

Even order responses are dealt with first which, like their "parent" Linkwitz-Riley responses, are more forgiving than the odd-order, Butterworth, responses of frequency and phase response errors in the drivers, and have better directional "lobing" properties.

Second Order Response: There are no useful second order functions.

Fourth Order Response: The high-pass and low-pass outputs are combined by addition.

$$F(sT_x)_{\Sigma 4} = \frac{\overbrace{(1+k^2s^2T_x^2)}^{\text{LOW-PASS}} + \overbrace{s^2T_x^2\ (k^2+s^2T_x^2)}^{\text{HIGH-PASS}}}{F(sT_x)_{DEN4}} \tag{3}$$

$F(sT_X)_{DEN4}$ is derived by factorising the numerator $$F(sT_X)_{NUM4}=1+2k^2s^2T_X^2+s^4T_X^4=[1+sT_X\sqrt{\{2(1-k^2)\}}+s^2T_X^2][1-sT_X\sqrt{\{2(1-k^2)\}}+s^2T_X^2] \tag{4}$$

For the equivalent minimum-phase function of $F(sT)_{DEN4}$ the minus sign of the second term becomes positive, so that $$F(sT_X)_{DEN4}=[1+x_4sT_X+s^2T_X^2]^2 \tag{5}$$

$$\text{where } x_4=\sqrt{[2(1-k^2)]} \tag{6}$$

from which the individual low-pass and high-pass functions are $$F(sT_x)_{LP4} = \frac{1+k^2s^2T_x^2}{[1+x_4sT_x+s^2T_x^2]^2} \tag{7}$$

and $$F(sT_x)_{HP4} = \frac{s^2T_x^2(k^2+s^2T_x^2)}{[1+x_4sT_x+s^2T_x^2]^2} \tag{8}$$

and the summed response is the second order all-pass function $$F(sT_x)_{\Sigma 4} = \frac{1-x_4sT_x+s^2T_x^2}{1+x_4sT_x+s^2T_x^2} \tag{9}$$

When k shrinks to zero, then $x_4$ becomes √2 as in the 2nd order Butterworth function, so that $F(sT_x)_{LP4}$ and $F(sT_x)_{HP4}$ become 4th order Linkwitz-Riley functions.

The generalised notched responses are plotted in FIG. 1, and the values for the fourth order responses are shown in Table 1 in terms of a crossover frequency $f_X$ of 1000 Hz. The height of the peak amplitude following the notch is $dB_{peak}$.

In the bottom row of Table 1, figures for group delay response of the Linkwitz-Riley function for k=0 are shown for comparison. Also the frequencies $dB_{40}$, $dB_{35}$ and $dB_{30}$, where the Linkwitz-Riley response is down 40 dB, 35 dB and 30 dB respectively, replace $f_{peakL}$, $f_{NL}$ etc.

It may be seen that steepness of the initial attenuation slope can be traded for magnitude of the following peak.

TABLE 1

Fourth Order Responses. Peak dB, Out-of-Band Frequencies (Hz) & Group Delays (μs) for various values of k

| $k^2$ | $dB_{peak}$ | $f_{peakL}$ | $f_{NL}$ | $f_{innerL}$ | $f_X$ | $f_{innerH}$ | $F_{NH}$ | $f_{peakH}$ | Insertion Delay (μs) | PeakGp Delay | at Hz |
|---|---|---|---|---|---|---|---|---|---|---|---|
| 1/3 | −30.4 | 414 | 577 | 633 | 1000 | 1580 | 1732 | 2415 | 368 | 613 | 796 |
| 1/4 | −35.7 | 355 | 500 | 550 | 1000 | 1820 | 2000 | 2818 | 390 | 589 | 759 |
| 1/5 | −39.7 | 316 | 447 | 491 | 1000 | 2037 | 2236 | 3162 | 403 | 577 | 741 |
| 0 | | 317 | 367 | 425 | 1000 | 2352 | 2726 | 3154 | 450 | 543 | 644 |
| | | $dB_{40L}$ | $dB_{35L}$ | $dB_{30L}$ | | $dB_{30H}$ | $dB_{35H}$ | $dB_{40H}$ | | | |

The responses at $f_X$ are −6.02 dB for all values of k. The group delay figures for other frequencies of $f_X$ can be scaled inversely with frequency from those quoted above.

Sixth Order Responses: The sixth order functions are derived in a manner similar to the fourth order functions. As in the sixth order Linkwitz-Riley functions, the high-pass and low-pass outputs are combined by subtraction.

$$F(sT_x)_{\Sigma 6} = \frac{\overset{\text{LOW-PASS}}{(1 + k^2 s^2 T_x^2)} - \overset{\text{HIGH-PASS}}{s^4 T_x^4 \ (k^2 + s^2 T_x^2)}}{[(1 + sT_x)(1 + x_6 sT_x + s^2 T_x^2)]^2} \tag{10}$$

$$\text{where } x_6 = \sqrt{(1-k^2)} \tag{11}$$

and the summed response is the third order all-pass function $$F(sT_x)_{\Sigma 6} = \frac{(1 - sT_x)(1 - x_6 sT_x + s^2 T_x^2)}{(1 + sT_x)(1 + x_6 sT_x + s^2 T_x^2)} \tag{12}$$

Eighth Order Responses: Again the eighth order functions are derived in a manner similar to that for the earlier functions. The low-pass and high-pass outputs are combined by addition.

$$F(sT_x)_{\Sigma 8} = \frac{\overset{\text{LOW-PASS}}{(1 + k^2 s^2 T_x^2)} + \overset{\text{HIGH-PASS}}{s^6 T_x^6 \ (k^2 + s^2 T_x^2)}}{[(1 + x_{81} sT_x + s^2 T_x^2)(1 + x_{82} sT_x + s^2 T_x^2)]^2} \tag{13}$$

$$\text{where } x_{81} = [\{(4-k^2) + \sqrt{(8+k^4)}\}/2]^{1/2} \tag{14}$$

$$\text{and } x_{82} = [\{(4-k^2) - \sqrt{(8+k^4)}\}/2]^{1/2} \tag{15}$$

and the summed response is the fourth order all-pass function $$F(sT_x)_{\Sigma 8} = \frac{(1 - x_{81} sT_x + s^2 T_x^2)(1 - x_{82} sT_x + s^2 T_x^2)}{(1 + x_{81} sT_x + s^2 T_x^2)(1 + x_{82} sT_x + s^2 T_x^2)} \tag{16}$$

TABLE 2

Sixth Order Responses. Peak dB, Out-of-Band Frequencies (Hz) & Group Delays (μs) for various values of k

| $k^2$ | $dB_{peak}$ | $f_{peakL}$ | $f_{NL}$ | $f_{innerL}$ | $f_X$ | $f_{innerH}$ | $f_{NH}$ | $f_{peakH}$ | Insertion Delay | Peak Gp Delay (μs) | at Hz |
|---|---|---|---|---|---|---|---|---|---|---|---|
| 0.5480 | −30.0 | 617 | 740 | 779 | 1000 | 1283 | 1351 | 1622 | 532 | 1146 | 930 |
| 0.4653 | −35.0 | 565 | 682 | 719 | 1000 | 1391 | 1466 | 1771 | 555 | 1075 | 915 |
| 0.3915 | −40.0 | 515 | 626 | 660 | 1000 | 1515 | 1598 | 1940 | 567 | 1025 | 901 |
| 0 | | 465 | 512 | 565 | 1000 | 1769 | 1951 | 2151 | 637 | 873 | 818 |
| | | $dB_{40L}$ | $dB_{35L}$ | $dB_{30L}$ | | $dB_{30H}$ | $dB_{35H}$ | $dB_{40H}$ | | | |

TABLE 3

Eighth Order Responses. Peak dB, Out-of-Band Frequencies (Hz) & Group Delays (μs) for various values of k

| $k^2$ | $dB_{peak}$ | $f_{peakL}$ | $f_{NL}$ | $f_{innerL}$ | $f_X$ | $f_{innerH}$ | $f_{NH}$ | $f_{peakH}$ | Insertion Delay | Peak Gp Delay (μs) | at Hz |
|---|---|---|---|---|---|---|---|---|---|---|---|
| 0.6628 | −30.0 | 719 | 814 | 843 | 1000 | 1186 | 1228 | 1392 | 710 | 1761 | 965 |
| 0.5906 | −35.0 | 675 | 769 | 797 | 1000 | 1255 | 1301 | 1483 | 727 | 1643 | 956 |
| 0.5224 | −40.0 | 632 | 723 | 750 | 1000 | 1333 | 1384 | 1581 | 742 | 1558 | 949 |
| 0 | | 652 | 606 | 563 | 1000 | 1534 | 1651 | 1776 | 832 | 1244 | 888 |
| | | $dB_{40L}$ | $dB_{35L}$ | $dB_{30L}$ | | $dB_{30H}$ | $dB_{35H}$ | $dB_{40H}$ | | | |

Odd Order Responses

In the same way as the "parent" Butterworth functions, the high-pass and low-pass outputs, which add in quadrature, can be summed either by addition or subtraction for a flat overall response. However, the maximum group delay error, i.e. the difference between the peak and insertion delays, is lower when the 3rd and 7th order outputs are subtracted and when the 5th (and 9th) order outputs are added.

Third Order Response:

$$F(sT_x)_{\Sigma 3} = \frac{\overset{\text{LOW-PASS}}{(1+k^2s^2T_x^2)} - \overset{\text{HIGH-PASS}}{sT_x\,(k^2+s^2T_x^2)}}{[(1+sT_x)(1+x_3sT_x+s^2T_x^2)]} \tag{17}$$

$F(sT_X)_{DEN3}$ is derived by first factorising the numerator $$F(sT_X)_{NUM3}=(1-k^2sT_X+k^2s^2T_X^2-s^3T_X^3)=(1-sT_X)[1+(1-k^2)sT_X+s^2T_X^2]$$

For the equivalent minimum-phase function of the denominator $F(sT_X)_{DEN3}$, the minus sign of the first term becomes positive, so that $$F(sT_X)_{DEN3}=(1+sT_X)[(1+(1-k^2)sT_X+s^2T_X^2)]$$

Thus $$F(sT_x)_{\Sigma 3} = \frac{(1-sT_x)(1+x_3sT_x+s^2T_x^2)}{(1+sT_x)[1+x_3sT_x+s^2T_x^2} = \frac{1-sT_x}{1+sT_x} \tag{18}$$

$$\text{where } x_3=1-k^2 \tag{19}$$

Fifth Order Response:

$$F(sT_x)_{\Sigma 5} = \frac{\overset{\text{LOW-PASS}}{(1+k^2s^2T_x^2)} + \overset{\text{HIGH-PASS}}{s^3T_x^3(k^2+s^2T_x^2)}}{(1+sT_x)(1+x_{51}sT_x+s^2T_x^2)(1+x_{52}sT_x+s^2T_x^2)} \tag{20}$$

$$= \frac{(1-x_{52}sT_x+s^2T_x^2)}{(1+x_{52}sT_x+s^2T_x^2)}\text{(second order all pass)} \tag{21}$$

$$\text{where } x_{51}=[-1+\sqrt{(5-4k^2)}]/2 \tag{22}$$

$$\text{and } x_{52}=[+1+\sqrt{(5-4k^2)}]/2 \tag{23}$$

Seventh Order Response:

$$F(sT_x)_{\Sigma 7} = \frac{\overset{\text{LOW-PASS}}{(1+k^2s^2T_x^2)} - \overset{\text{HIGH-PASS}}{s^5T_x^5(k^2+s^2T_x^2)}}{(1+sT_x)(1+x_{71}sT_x+s^2T_x^2)(1+x_{72}sT_x+s^2T_x^2)(1+x_{73}sT_x+s^2T_x^2)} \tag{24}$$

$$= \frac{(1-sT_x)(1-x_{72}sT_x+s^2T_x^2)}{(1+sT_x)(1+x_{72}sT_x+s^2T_x^2)}\text{(third order all pass)} \tag{25}$$

The x coefficients of the factors of the seventh order numerator are found from the roots of the equation $$x_7^3-x_7^2-(2-k^2)x_7+(1-k^2)=0 \tag{26}$$

Of the three roots the largest and the smallest magnitudes $x_{71}$ and $x_{73}$ are positive. The middle magnitude root is negative, and its sign is changed to positive to produce $x_{72}$. Thus for example, when $k^2=0.5$, the roots of the equation are +1.7071, −1.0000 and +0.2929, so the coefficients $x_{71}$, $x_{72}$ and $x_{73}$ are 1.7071, 1.000 and 0.2929 respectively.

Typical results for the odd order responses are not tabulated because they are believed to be of less interest than the even order responses.

Special Uses of Notched Crossovers

In notched crossovers, the initial slope of attenuation is greatly increased over that of an un-notched filter of the same order, and the minimum out-of-band attenuation can be chosen by the designer, 30 dB, 35 dB, 40 dB or whatever. However the attenuation slope is eventually reduced by 12 dB per octave at extreme frequencies. The maximum group delay error is also increased somewhat, though never as much as that for the un-notched filter two orders greater.

These functions should be specially useful when crossovers must be made at frequencies where one or other driver, assumed to be ideal in theory, has an amplitude and phase response that deteriorates rapidly out-of-band, a horn for example near its cut off frequency. Another application is in crossing over to a stereo pair from a single sub-woofer, whose output must be maintained to as high a frequency as possible so as to minimise the size of the higher frequency units, yet not contribute significantly at 250 Hz and above where it could muddy localisation.

Realising the Filters

From the designer's point of view, the crossovers are most easily realised as active filters, with each second order factor of the transfer functions realised in the well-known Sallen and Key configuration [R. P. Sallen & B. L. Key—*A*

*practical method of designing RC active filters—Trans. IRE*, Vol CT-2, March 1955, pp. 74–85]. An exception is the one factor which provides the notch, with a transfer function of the form, for the low-pass filter, $$F(sT_x) = \frac{1 + qs(kT_X) + s^2(kT_X)^2}{1 + xsT_X + s^2T_X^2} \quad (27)$$

and for the high-pass filter, $$F(sT_x) = \frac{1 + qs(T_X/k) + s^2(T_X/k)^2}{1 + xsT_X + s^2T_X^2} \quad (28)$$

where q is ideally zero and x is the coefficient appropriate to one factor of the desired denominator, e.g. $x_4=\sqrt{\{2(1-k^2)\}}$ for the factors of the fourth order crossover.

While q may be made zero in active filters using cancellation techniques, which depend on the balance between component values, quite small values of q can be realised in a Sallen and Key filter that incorporates a bridged T network [R. P. Sallen & B. L. Key—*A practical method of designing RC active filters—Trans. IRE*, Vol CT-2, March 1955, pp. 74–85, A. N. Thiele—*Loudspeakers, enclosures and equalisers—Proc. IREE Aust*, Vol. 34, No. 11, November 1973, pp. 425–448]. Unless a deep notch is really necessary, it will often be sufficient to let the notch "fill up" with a finite value of q. In passive filters, its reciprocal Q (=1/q), the "quality factor" of the reactive elements, has the same effect.

In the sixth order notched crossover, for example, when the height of out-of band peaks are −30 dB, −35 dB and −40 dB, then figures for q of 0.16, 0.14 and 0.10 respectively ensure that the attenuation at the erstwhile notch frequency is no less than at the erstwhile peak and that there is no significant change in response at neighbouring frequencies.

Figure 9:
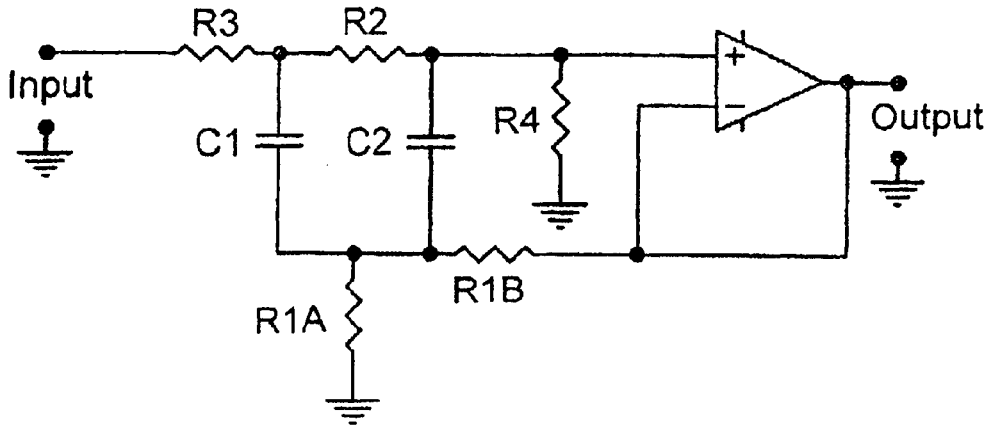
FIG. 9. shows a Sallen & Key active filter incorporating a bridged-T network.

Component values are tabulated in Table 4 for the network of FIG. 9 to realise the function $$F(sT_D) = \frac{1 + x_N sT_N + s^2T_N^2}{1 + x_D sT_D + s^2T_D^2} \quad (29)$$

The second factor of the sixth order transfer function is produced by active high-pass (with numerators of $s^2T_X^2$) or low-pass filters (with numerators of 1) with denominators $1+x_DsT_D+s^2T_D^2$, where $x_D$ and $T_D$ are as specified, for example, in Table 4.

Figure 10:
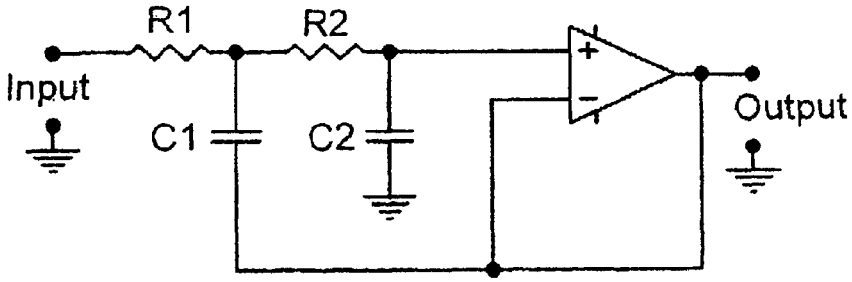
FIG. 10 shows a Sallen & Key active low-pass filter.

The low-pass transfer function $$F(sT_D)_{LP} = \frac{1}{1 + x_D sT_D + s^2T_D^2} \quad (30)$$

is realised by the circuit of FIG. 10. First, component values are chosen for C1 and C2. Then the resistances R1 and R2 are defined as the two values of $$R1, R2=[T_D/C2][(x_D/2)\pm\sqrt{\{(x_D/2)^2-(C2/C1)\}}] \quad (31)$$

Note that C2/C1 must be less than $(x_D/2)^2$. The nearer the two ratios are to each other, the more nearly equal will be R1 and R2. Preferably R1 is chosen as the larger.

Figure 11:
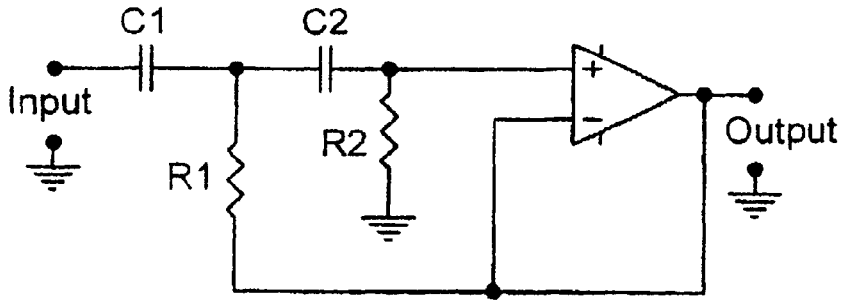
FIG. 11 shows a Sallen & Key active high-pass filter.
Figure 12A:
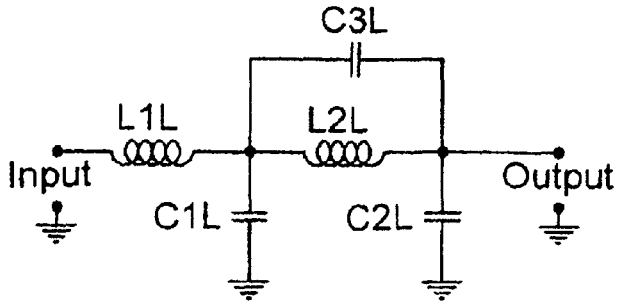
FIG. 12(*a*) shows a passive fourth-order low-pass filter (first kind)
Figure 12B:
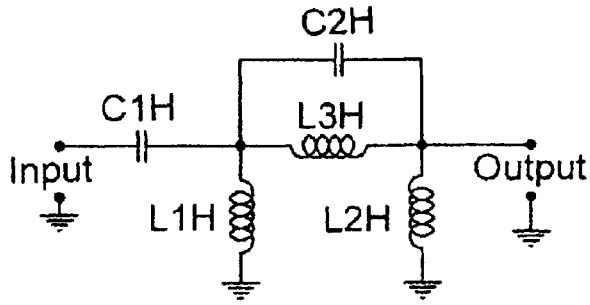
Figure 12C:
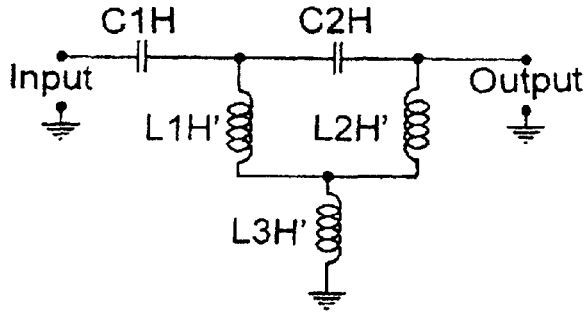
Figure 12D:
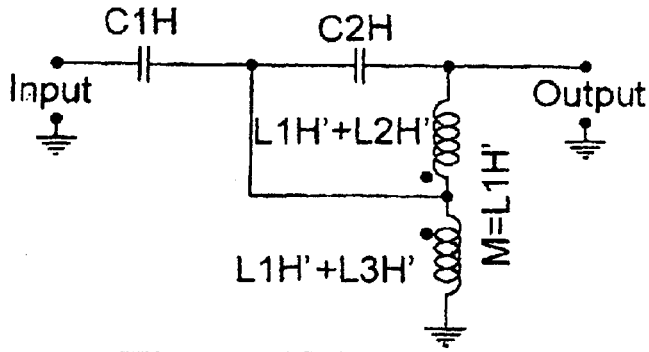

The high-pass transfer function $$F(sT_D)_{HP} = \frac{s^2T_D^2}{1 + x_D sT_D + s^2T_D^2} \quad (32)$$

is realised by the circuit of FIG. 11. C1 and C2 are chosen preferably as equal values C1. Then $$R1=(x_D/2)(T_D/C1) \quad (33)$$

$$\text{and } R2=(2/x_D)(T_D/C1) \quad (34)$$

There still remain the transfer functions with the denominators $$F(sT_D)=(1+sT_D)^2 \quad (35)$$

These can be realised simply by cascading two CR sections whose CR products are each $T_D$. In each filter one CR network could be cascaded with the input, the other with the output. Alternatively the second order functions could be realised in the Sallen and Key filters of FIGS. 10 & 11 with $x_D$=2, where for both high-pass and low-pass filters C1 is equal to C2 and R1, equal to R2, is $T_D$/C1.

TABLE 4

Component Values for Sallen & Key Active Filters incorporating a Bridged-T Network, realising Low-Pass and High-Pass Filters for 6th Order Notched Crossovers with $f_X$ = 1 kHz.

$T_X = T_D$ = 159.2 μs: $(T_N)_{LP} = kT_X$: $(T_N)_{HP} = T_X/k$

Both capacitances C1 & C2 are 4.7 nF: all resistances in kohms

| k | Filter type | $x_N$ | $T_N$ | $x_D$ | $T_D$ | R1a | R1b | R2 | R3 | R4 |
|---|---|---|---|---|---|---|---|---|---|---|
| 0.7403 | LP | 0.1600 | 117.8 | 0.6723 | 159.2 | 40.68 | 2.109 | 313.4 | 33.55 | ∞ |
| (−30 dB) | HP | 0.1600 | 215.0 | 0.6723 | 159.2 | 74.23 | 3.849 | 571.8 | 0 | 693.3 |
| 0.6821 | LP | 0.1400 | 108.6 | 0.7313 | 159.2 | 29.95 | 1.709 | 330.0 | 34.42 | ∞ |
| (−35 dB) | HP | 0.1400 | 233.3 | 0.7313 | 159.2 | 64.37 | 3.674 | 709.2 | 0 | 617.0 |
| 0.6257 | LP | 0.1000 | 99.58 | 0.7801 | 159.2 | 21.37 | 1.115 | 423.7 | 33.22 | ∞ |
| (−40 dB) | HP | 0.1000 | 254.4 | 0.7801 | 159.2 | 54.59 | 2.847 | 1082 | 0 | 696.3 |

In this way, each overall sixth-order transfer function is realised by cascading two or three active stages $$F(sT_x)_{LP} = \frac{1 + qksT_X + k^2s^2T_X^2}{1 + x_6sT_X + s^2T_X^2} * \frac{1}{1 + x_6sT_X + s^2T_X} * \frac{1}{1 + 2sT_X + s^2T_X^2} \quad (36)$$

and $$F(sT_x)_{HP} = \frac{k^2 + qksT_X + s^2T_X^2}{1 + x_6sT_X + s^2T_X^2} * \frac{s^2T_X^2}{1 + x_6sT_X + s^2T_X^2} * \frac{s^2T_X^2}{1 + 2sT_X + s^2T_X^2} \quad (37)$$

and the high and low-frequency drivers are connected in opposite polarities. The coefficient q is of course ideally zero.

The addition of signals to produce a seamless, flat, output assumes of course ideal drivers. If the response errors of the higher frequency, tweeter, driver exceed the propensities for forgiveness of the even order crossover, the middle factor of eqn (37) could be substituted by the equalising transfer function $$F(sT_x) = \frac{1 + sT_S / Q_T + s^2T_S^2}{1 + x_6sT_X + s^2T_X^2} \quad (38)$$

where $T_S = \frac{1}{2}\Pi f_S$ and $f_S$ is the resonance frequency of the tweeter and $Q_T$ its total Q. This could be realised in an active filter of the same kind as FIG. 9 [A. N. Thiele—*Loudspeakers, enclosures and equalisers—Proc. IREE Aust*, Vol. 34, No. 11, November 1973, pp. 425–448] When this function is cascaded with the transfer function of the driver $$F(sT_s) = \frac{s^2T_S^2}{1 + sT_S / Q_T + s^2T_S^2} \quad (39)$$

the numerator of eqn (38) cancels with the denominator of eqn (39) to produce the ideal transfer function of the middle factor of eqn. (37).

However, this procedure applies only to crossover functions of sixth or higher order. It must be remembered that the notched crossover, while a sixth order function around the transition frequency, goes to a fourth order slope at extreme frequencies. Thus, because the excursion of a driver rises towards low frequencies at 12 dB per octave above its frequency response, its excursion is attenuated only 12 dB per octave after such equalisation of a sixth order high-pass notched filter.

If a similar procedure were applied to a tweeter with a 4th order notched crossover function, it would afford incomplete protection against excessive excursion at low frequencies.

Passive Filters

The fourth order passive filters can be realised using the networks of either FIG. 12 or FIG. 13. Either C3L is parallelled across L2L, as in FIG. 12(*a*)—or L3H across C2H as in FIG. 12(*b*)—or L3L is inserted in series with C1L, as in FIG. 13(*a*)—or C3H in series with L1H as in FIG. 13(*c*). The component values for a low-pass filter of the first kind, in FIG. 12(*a*), are calculated from the expressions $$C1L=[3(3-k^2)/4x_4][T_X/R_O] \quad (40)$$

$$C2L=[(1-3k^2)/2x_4][T_X/R_O] \quad (41)$$

$$C3L=[k^2(3-k^2)/\{2x_4(1-k^2)\}][T_X/R_O] \quad (42)$$

$$L1L=[4x_4/(3-k^2)]T_XR_O \quad (43)$$

$$L2L=[2x_4(1-k^2)/(3-k^2)]T_XR_O \quad (44)$$

$$\text{where } x_4=\sqrt{[2(1-k^2)]} \quad (6)$$

The corresponding high-pass components are calculated from the low-pass components, in all cases, using the generalised expressions $$CnH=T_X^2/LnL \quad (45)$$

$$\text{and } LnH=T_X^2/CnL \quad (46)$$

The resulting high-pass filter, FIG. 12(*b*), can additionally be adapted to sensitivity control using an auto-transformer [D. E. L. Shorter—*A survey of performance criteria and design considerations for high quality monitoring loudspeakers—Proc. IEE* 105 Part B, 24 November 1958, pp. 607–622 also reprinted and in *Loudspeakers, An Anthology*, Vol 1–Vol 25 (1953–1977), ed. R. E. Cooke—*Audio Engineering Society*, inc, New York, October 1978, pp. 56–71, A. N. Thiele—*An air cored auto-transformer* (to be published)]. However that network requires high values in the Π network of inductances transformed from the Π network of capacitances C1L, C2L and C3L, especially L2H, transformed from the small values of C2L. In fact, when $k^2$ is ⅓, then C2 is zero and L2H goes to infinity. They are more easily realised from a Δ-Y transformation into the network of FIG. 12(*c*), where $$C1H=[(3-k^2)/4x_4][T_X/R_O] \quad (47)$$

$$C2H=[(3-k^2)/2x_4(1-k^2)][T_X/R_O] \quad (48)$$

$$L1H'=[4x_4(1-k^2)(1-3k^2)/(3-k^2)^2]T_XR_O \quad (49)$$

$$L2H'=[6x_4(1-k^2)/(3-k^2)]T_XR_O \quad (50)$$

$$L3H'=[4x_4k^2/(3-k^2)]T_XR_O \quad (51)$$

The set of three inductances can be realised either individually or, more conveniently, from two inductors $$L1H'+L2H'=[2x_4(1-k^2)(11-9k^2)/(3-k^2)^2]T_XR_O \quad (52)$$

$$L1H'+L3H'=[4x_4(1-k^2+2k^4)/(3-k^2)^2]T_XR_O \quad (53)$$

which are wound separately and then coupled together in series opposition so that their mutual inductance is L1H', i.e. the coupling coefficient between them is $$|k_{COUPLING}|=[2(1-k^2)(1-3k^2)^2/(1-k^2+2k^4)(11-9k^2)]^{1/2} \quad (54)$$

The resulting filter, FIG. 12(*d*), may look rather strange but is eminently practical. The mutual inductance is realised in L1H' rather than L3H' because that procedure leads to smaller sum inductances L1H'+L2H' and L1H'+L3H' over the range of $k^2$ between 0.333 and 0.157 that is of most practical use. The coupling coefficients $k_{COUPLING}$ are small enough to be easily achieved. To produce the required coupling, the spacing between the two coils is adjusted until their inductance, measured end to end, is L2H'+L3H'. The procedure realises all the inductances in the one unit, which can include an air-cored auto-transformer [A. N. Thiele—*An air cored auto-transformer* (to be published)] and is easily mounted without any worry about stray couplings between individual inductors.

In the alternative realisations of the second kind, in FIG. 13(*a*), the low-pass components are $$C1L=[9(1-k^2)/4x_4][T_X/R_O] \quad (55)$$

$$C2L=T_X/2x_4R_O \quad (56)$$

$$L1L=4x_4T_XR_O/3 \quad (57)$$

$$L2L=2x_4T_XR_O/3 \quad (58)$$

$$L3L=[4x_4k^2/9(1-k^2)]T_XR_O \quad (59)$$

This second version of the low-pass filter, FIG. 13(*a*) again needs three inductances, and can again be produced by winding one coil to a value of L1L+L3L another with a value of L2L+L3L and coupling them together in series opposition to produce L3L as the mutual inductance between them, as in FIG. 13(*b*). This is again produced by varying their coupling until $$|k_{COUPLING}|=[2k^4/(3-2k^2)(3-k^2)]^{1/2} \quad (60)$$

and the inductance end-to-end reads L1L+L2L. Again there is only the one component to mount and no further need to position the inductors to avoid stray coupling. Also in this case, because the mutual inductance L3L is free of a resistive component, the filter is capable of a better null.

The high-pass component values for FIG. 13(*c*) are again derived from the low-pass values via eqns (45) and (46).

Each version has its uses. In the first kind, FIG. 12(*a*), C2L goes to zero when $k^2=1/3$, i.e. when the following peak height is −30.4 dB. Larger values of k require a negative mutual inductance, but are unlikely to be needed in practice, with following peak heights higher than −30 dB. The high pass filter of the second kind, FIG. 13(*c*) is less desirable than the first kind. It requires three capacitors, one of which C3 is comparatively large.

Component values for a crossover frequency of 1000 Hz and a terminating resistance of 10 ohms are presented in Table 5 for all four realisations of each of the three fourth order versions, with following peaks of approximately −30 dB, −35 dB and −40 dB.

Input Impedance

The input impedances of the passive filters are identical for the two kinds of realisations in FIGS. 12 and 13.

The input impedances of passive crossover filters are best assessed by splitting them into parallel components of resistance R and reactance X, that of the low-pass filter into $R_{LP}$ and $X_{LP}$ and that of the high-pass filter into $R_{HP}$ and $X_{HP}$. The resistances $R_{LP}$ and $R_{HP}$ vary in inverse proportion to their responses or, more precisely, to the powers that reach their outputs.

When the inputs of the two filters are connected in parallel, the resulting joint input resistance is $$R_{IN}=R_{LP}R_{HP}/(R_{LP}+R_{HP}) \quad (61)$$

while the joint input reactance $$X_{IN}=X_{LP}X_{HP}/(X_{LP}+X_{HP}) \quad (62)$$

$$\text{Then } Z_{IN}=1/\sqrt{[(1/R_{IN}^2)+(1/X_{IN}^2)]} \quad (63)$$

Values of these quantities, for a notched crossover with $k^2=1/3$, i.e. k=0.5774, derived as in Appendix A, are shown in Table 6.

TABLE 5

Fourth Order Passive Notched Crossovers. Component Values for $f_X$ = 1000 Hz and $R_0$ = 10 ohms Low-Pass Filter (with C3 in parallel with L2)

| k | L1 (μH) | C1 (μF | L2 (μF) | C3 (μF) | C2 (μF) |
|---|---|---|---|---|---|
| 0.5774 | 2757 | 27.57 | 919 | 9.189 | 0 |
| 0.5000 | 2835 | 26.80 | 1063 | 5.956 | 1.624 |
| 0.4472 | 2876 | 26.42 | 1150 | 4.404 | 2.516 |
| 0 | 3001 | 25.32 | 1501 | 0 | 5.627 |

High-Pass Filter (with L1 L2 & L3 in network around C2)

| k | C1 (μF) | L1 (μH) | C2 (μF) | L3 (μH) | L2 (μH) | $k_{COUPLING}$ |
|---|---|---|---|---|---|---|
| 0.577 | 9.189 | 0 | 27.57 | 918.9 | 2757 | 0 |
| 0.5000 | 8.934 | 193.3 | 23.82 | 708.8 | 3190 | 0.1107 |
| 0.4472 | 8.808 | 328.7 | 22.02 | 575.2 | 3451 | 0.1778 |
| 0 | 8.440 | 1000.3 | 16.88 | 0 | 4502 | 0.4264 |

Low-Pass Filter (with L3 in series with C1)

| k | L1 (μH) | C1 (μF) | L3 (μH) | L2 (μH) | C2 (μF) | $k_{COUPLING}$ |
|---|---|---|---|---|---|---|
| 0.5774 | 2450 | 20.68 | 408.4 | 1225 | 6.892 | 0.1890 |
| 0.5000 | 2599 | 21.93 | 288.8 | 1299 | 6.497 | 0.1348 |
| 0.4472 | 2684 | 22.65 | 223.7 | 1342 | 6.291 | 0.1048 |
| 0 | 3001 | 25.32 | 0 | 1501 | 5.627 | 0 |

High-Pass Filter (with C3 in series with L1)

| k | C1 (μF) | L1 (μH) | C3 (μF) | C2 (μF) | L2 (μF) |
|---|---|---|---|---|---|
| 0.5774 | 10.34 | 1225 | 62.02 | 20.68 | 3676 |
| 0.5000 | 9.746 | 1155 | 87.72 | 19.49 | 3898 |
| 0.4472 | 9.437 | 1118 | 113.2 | 18.87 | 4026 |
| 0 | 8.440 | 1000 | ∞ | 16.88 | 4502 |

TABLE 6

Input Impedance ZIN and Parallel Components of Resistance R and Reactance X (ohms) of Fourth Order Notched Low Pass and High Pass Filters Crossover frequency $f_X$ = 1000 Hz, Notch ratio k = 0.5774, Terminating Resistance = 10 ohms

| f (Hz) | 316 | 398 | 501 | 631 | 794 | 1000 | 1259 | 1585 | 1995 | 2512 | 3162 |
|---|---|---|---|---|---|---|---|---|---|---|---|
| $R_{LP}$ (Ω) | | 9.5 | 9.4 | 9.6 | 10.6 | 15.3 | 40.0 | 270.9 | 12.0K | 18.8K | 11.0K |
| | 16.3K | | $X_{LP}$ (Ω) | 42.1 | 29.6 | 20.2 | 14.0 | 10.9 | 11.6 | 16.2 | 23.6 |
| 31.9 | 41.5 | 53.1 | | | | | | | | | |
| $R_{HP}$ (Ω) | | 16.3K | 11.0K | 18.8K | 12.0K | 270.9 | 40.0 | 15.3 | 10.6 | 9.6 | 9.4 |
| 9.5 | $X_{HP}$ (Ω) | −53.1 | −41.5 | −31.9 | −23.6 | −16.2 | −11.6 | −10.9 | −14.0 | −20.2 | −29.6 |
| | −42.1 | | | | | | | | | | |
| $R_{LP//HP}$ (Ω) | 9.5 | 9.4 | 9.6 | 10.6 | 14.5 | 20.0 | 14.5 | 10.6 | 9.6 | 9.4 | 9.5 |
| $X_{LP//Hp}$ (Ω) | 203.1 | 103.4 | 55.3 | 34.3 | 33.6 | ∞ | −33.6 | −34.3 | −55.3 | −103.4 | 203.1 |
| $Z_{IN}$ (Ω) | 9.5 | 9.4 | 9.4 | 10.1 | 13.3 | 20.0 | 13.3 | 10.1 | 9.4 | 9.4 | 9.5 |

Figure 14:
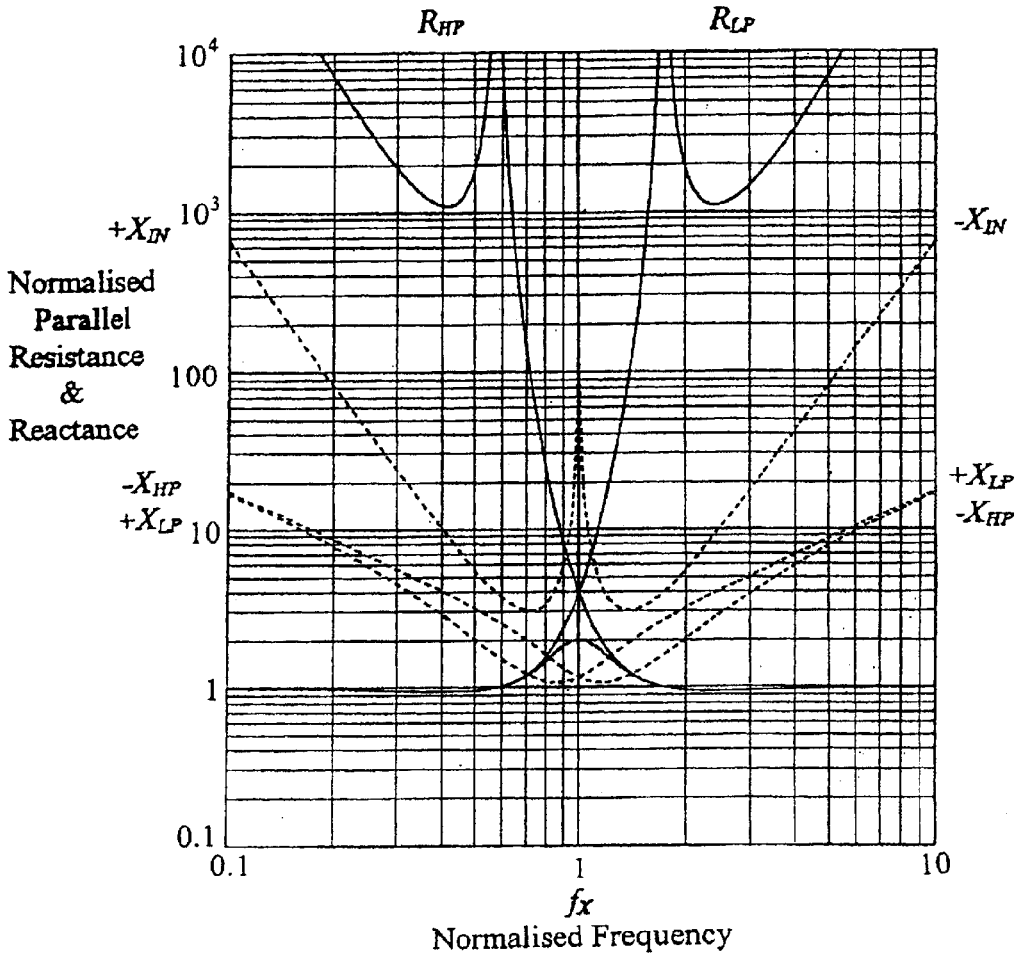
FIG. 14 shows normalised input resistances and reactances of passive fourth-order filters with k=0.5774 ($k^2=1/3$): typical of all fourth-order notched crossovers.
Figure 15:
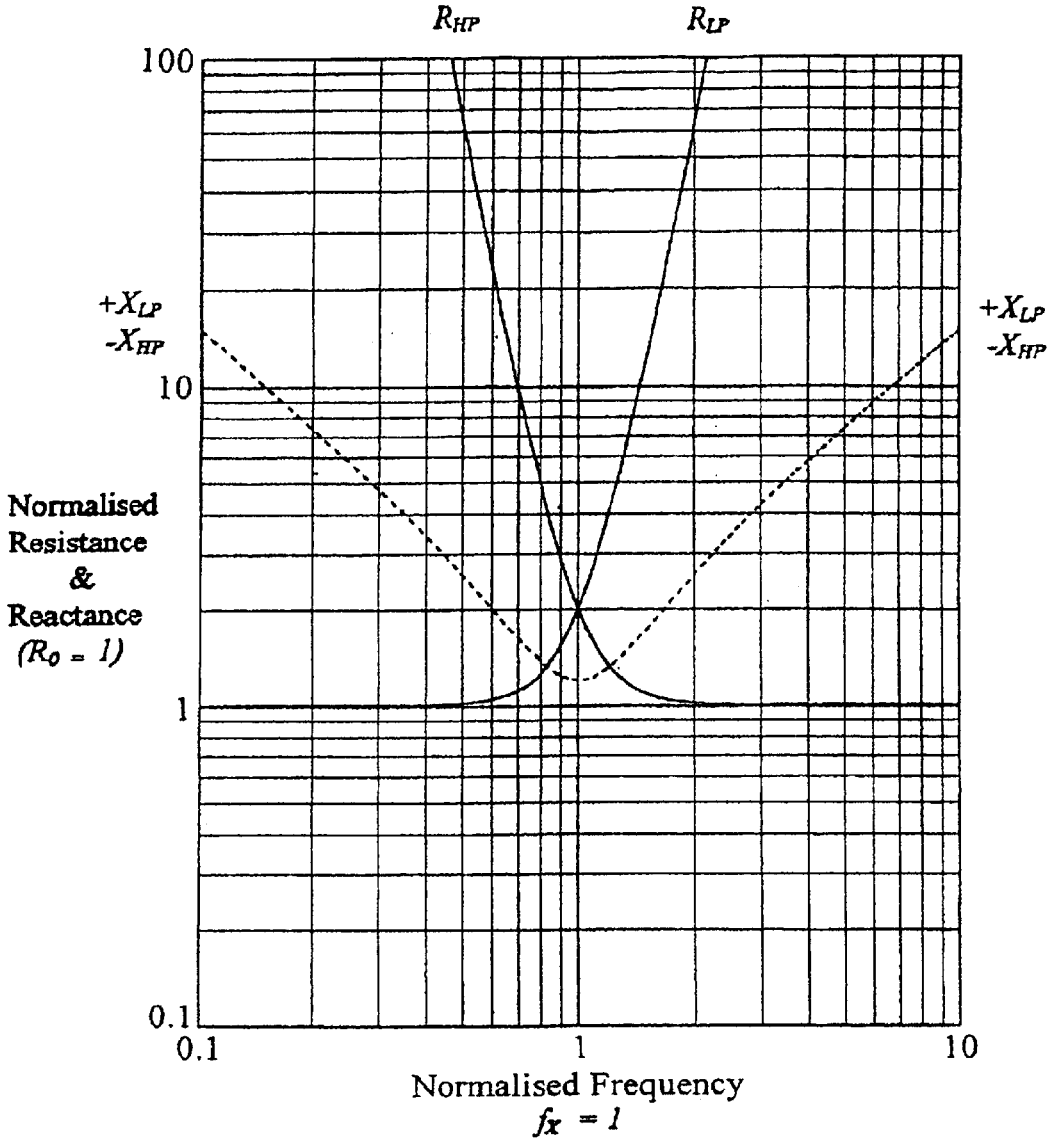
FIG. 15 shows normalised input resistances and reactances of third-order passive filters for Butterworth crossovers.
Figure 16:
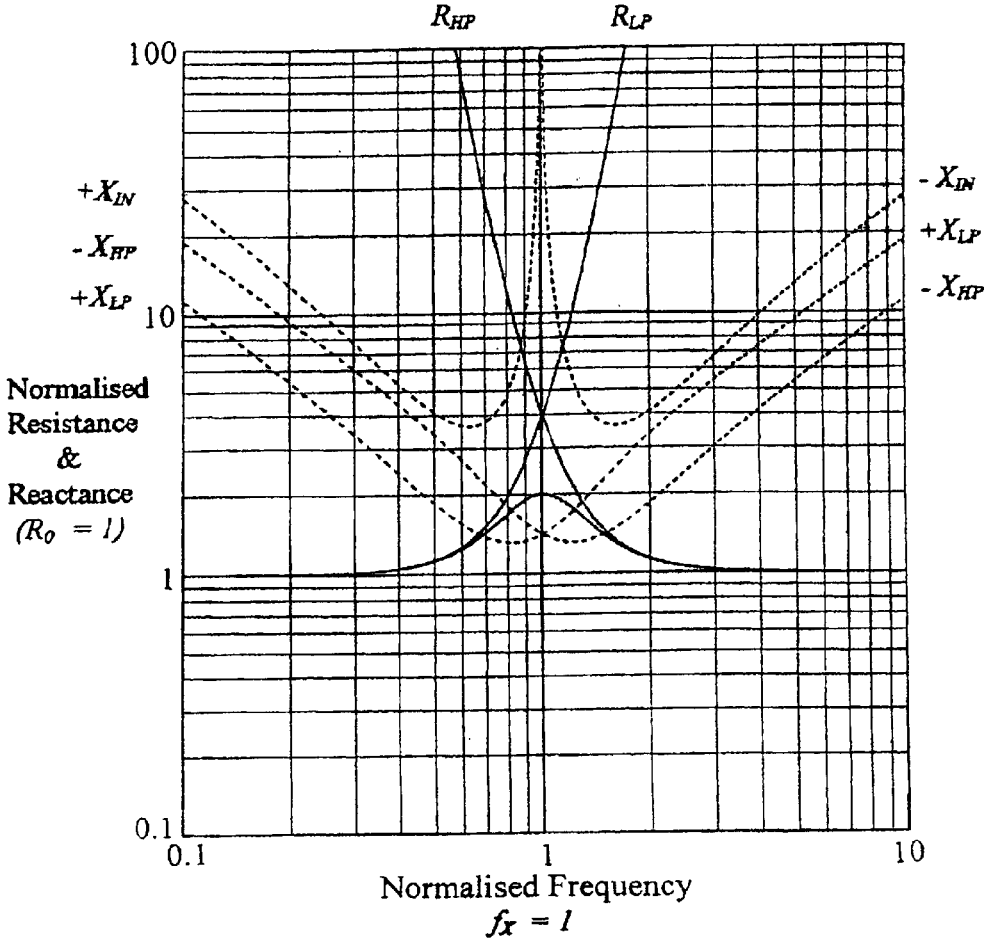
FIG. 16 shows normalised input resistances and reactances of fourth-order passive filters for Linkwitz-Riley crossovers (equivalent to notched crossovers with k=0)

They are also plotted in FIG. 14, where they can be compared with similar plots in FIG. 15, for a Butterworth crossover, and FIG. 16, for a Linkwitz-Riley crossover which, as we have seen already, may be considered as a notched crossover with k=0.

In FIG. 14 solid curves show $R_{HP}$ (top left), $R_{LP}$ (top right) and $R_{IN}$ (lowest middle), and dashed curves show $X_{LP}$ (lowest on left), $X_{HP}$ (middle) and $X_{IN}$ (upper on left). $X_{LP}$ is +ve at all frequencies and $X_{HP}$ is −ve at all frequencies, so $-X_{HP}$ is plotted at all frequencies. $X^{IN}$ is +ve at low frequencies and −ve at high frequencies, so $-X_{IN}$ is plotted at high frequencies.

In FIG. 15 solid curves show $R_{HP}$ (top left) and $R_{LP}$ (top right) and dashed curves show $X_{LP}$ for low-pass filter. $X_{HP}$ has identical magnitude but −ve sign. $R_{IN}$=1 at all frequencies and $X_{IN}$ is infinite at all frequencies. Therefore neither is plotted.

in FIG. 16 solid curves show $R_{HP}$ (top left), $R_{LP}$ (top right) and $R_{IN}$ (lowest middle), and dashed curves show $X_{LP}$ (lowest on left), $X_{HP}$ (middle) and $X_{IN}$ (upper on left). $X_{LP}$ is +ve at all frequencies and $X_{HP}$ is −ve at all frequencies, so $-X_{HP}$ is plotted at all frequencies. $X_{IN}$ is +ve at low frequencies and −ve at high frequencies, so $-X_{IN}$ is plotted at high frequencies.

In FIG. 15, the normalised input resistance $R_{IN}$ for the Butterworth crossover is 1 at all frequencies, so there is no point in plotting it. Since $X_{LP}=-X_{HP}$, their sum $X_{LP}+X_{HP}$ is zero and therefore $X_{IN}$ is infinite at all frequencies. This applies only to Butterworth crossovers, and then only when both filters are terminated in the same resistance $R_0$. However if, for example, $X_{LP}=-1.5X_{HP}$, their combined $X_{IN}$ would be $3X_{HP}$, i.e. $-2X_{LP}$, and if $R_{LP}=1.5R_{LP}$ then $R_{IN}=0.6R_{HP}$. In both cases $R_{IN}$ and $X_{IN}$ would vary with frequency.

The input impedance of the notched and Linkwitz-Riley crossovers varies in a rather more complicated manner. The resistive and reactive components for the high-pass and low-pass filters are symmetrical in frequency in that their magnitudes for the high-pass filter at any frequency $nf_X$ are the same as those for the low-pass filter at the frequency $f_X/n$. The sign of the reactive components is always negative for the high-pass filter and always positive for the low-pass filter but their magnitudes are equal, and cancel in parallel, only at the transition frequency. At other frequencies, the magnitude of their combined reactance is never less than 3 times the nominal, terminating, impedance $R_0$. The resistive component of each filter is $4R_0$ at the transition frequency, (the two in parallel present $2R_0$), rising rapidly at frequencies outside the pass-band.

In the notched crossover filters, the resistive component diminishes within the pass-band through $R_0$ at the notch frequency of the other filter to a minimum, never lower than $0.94R_0$, before returning to $R_0$ at extreme frequencies. The reason is that, as explained earlier, each filter must, at frequencies in its pass-band beyond the notch of the other filter, deliver a power a little greater (0.27 dB maximum) than its input so as to maintain a flat combined output. To produce more power from a low (virtually zero) impedance source, the filter must present a lower resistance component of input impedance.

Table 6 and FIGS. 14, 15 & 16 show that, in all types, the resistance component tends to dominate the input impedance. For example, if $R_{IN}$ is 10 Ω and $X_{IN}$ is 30 Ω, then $Z_{IN}$ is 9.49 Ω. Nevertheless the presence of shunt reactance and its possible effect on the driving amplifier should always be kept in mind.

Like most passive crossovers, these networks require ideally an accurate and purely resistive termination. Unless the driver presents a good approximation to such a resistance, its input terminals will need to be shunted by an appropriate impedance correcting network[A. N. Thiele—*Optimum passive loudspeaker dividing networks—Proc. IREE Aust*, Vol 36, No 7, July 1975, pp. 220–224].

The notched crossover systems, especially those using even order functions, offer improvements in performance, particularly when rapid attenuation is needed close to the transition frequency. Although their performance in lobing with non-coincident drivers has not been examined specifically, it is expected to be similar to that of the Linkwitz-Riley crossovers, because their two outputs maintain a constant zero phase difference across the transition.

The passive filters that utilise coupling between inductors also offer convenience in realisation and in mounting in the cabinet as a single unit.

The odd-order functions, whose high-pass and low-pass outputs add in quadrature, have been included for completeness, though they would seem to be of less general interest than those of even order.

Non Electrical Domains

The present invention is readily applied to domains other than electrical domains because there exists a well understood correspondence between quantities such as current, voltage, capacitance, inductance and resistance in the electrical domain and counterparts thereof in the other domains. Table 7 shows the correspondence between analogous quantities in the electrical, mechanical and acoustical domains. The quantities are analogous because their differential equations of motion are mathematically the same.

TABLE 7

| Electrical | | Mechanical | | Acoustical | |
|---|---|---|---|---|---|
| Current | Amps | Velocity | m/sec | Volume velocity | $m^3$/sec |
| Voltage | Volts | Force | N | Pressure | $N/m^2$ or Pa |
| Capacitance | Farads | Mass | kg | Acoustical compliance | $m^5/N$ |
| Inductance | Henrys | Mechanical compliance | m/N | Acoustical mass | $kg/m^4$ |
| Resistance | Ohms | Mechanical responsiveness | m/Nsec | Acoustical resistance | $Nsec/m^5$ |

Figure 17:
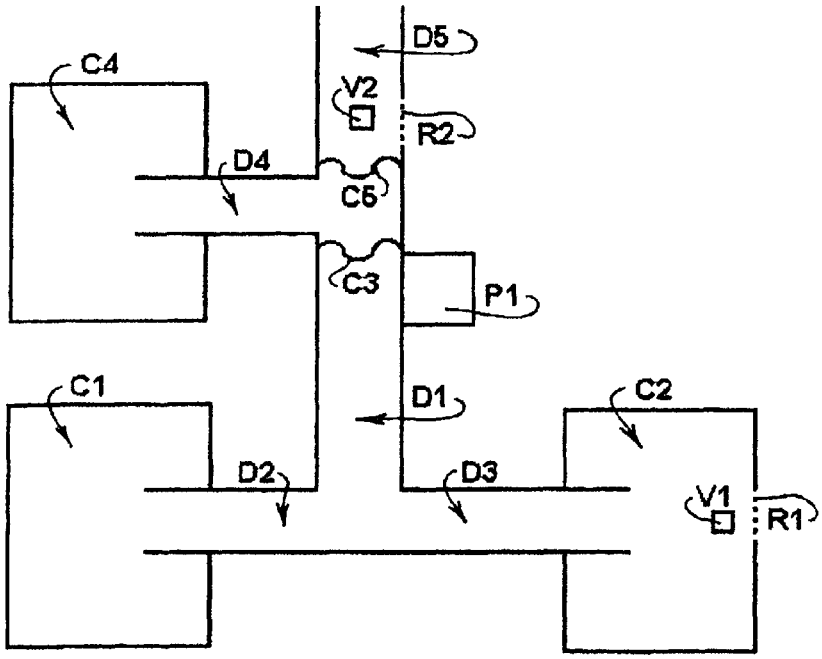
FIG. 17 shows an analog in the acoustical domain of the low-pass and high-pass filters shown in FIGS. 13(*a*) and 13(*b*).
Figure 13A:
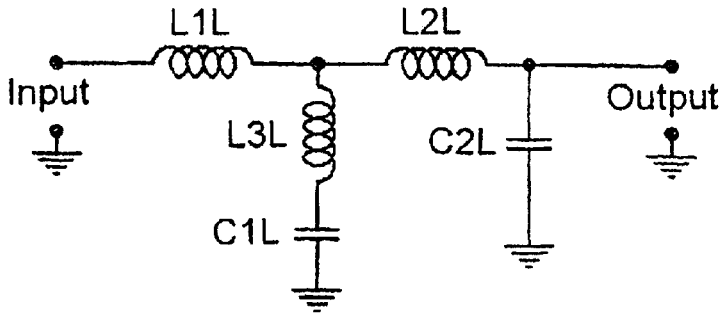
FIG. 13(*a*) shows a passive fourth-order low-pass filter (second kind)
Figure 13B:
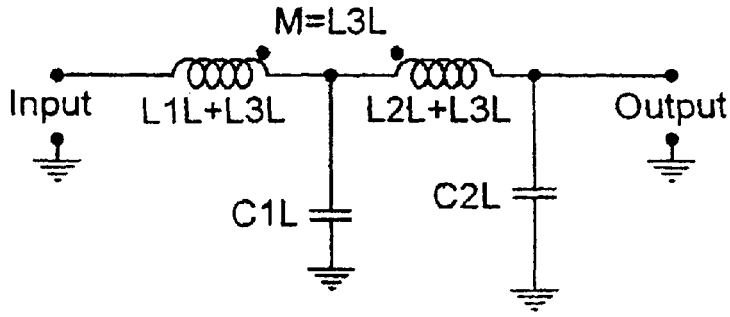
Figure 13C:
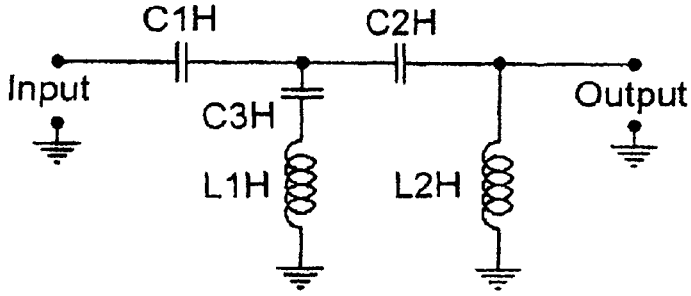
Figure 13D:
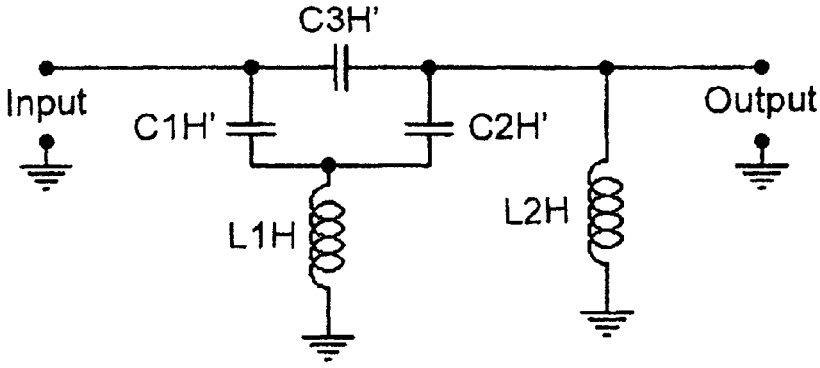

FIG. 17 shows an example of a filter realized in an acoustical domain which is a direct analog of the low pass and high pass filters shown in FIGS. 13*a* and 13*c*. In FIG. 17 C1, C2 and C4 are vented chambers, C3 and C5 are flexible membranes, D1 to D5 are ducts which may be of any cross-sectional shape but in this example will be assumed to be circular, and R1 to R2 are sieves which dissipate energy from fluids passing through them.

The input is pressure generator P1. The low frequency output is pressure at sensor V1 and the high frequency output is pressure at sensor V2.

Assume that the crossover frequency $f_x$ is 10 Hz. Then $T_x=1/(2\pi f_x)=15.9$ mS.

Assume that $dB_{peak}$ in FIG. 1 is set at −40 dB, then according to Table 1, $k^2=0.2$, therefore k=0.447.

Assume that the sieves R1 and R2 each have acoustic resistance of 2000 $NS/m^5$.

According to Equation 6, $x_4=\sqrt{[2(1-k^2)]}=1.265$.

Using Equations 55 to 59 the following values are obtained.

C1L=11 uF, C2L=3.1 uF, L1L=53 H, L2L=26 H, L3L=4.4 H

Duct D1 corresponds to L1L and has a corresponding acoustic mass of 53 $kg/m^4$.

Duct D2 corresponds to L3L and has a corresponding acoustic mass of 4.4 $kg/m^4$.

Duct D3 corresponds to L2L and has a corresponding acoustic mass of 26 $kg/m^4$.

Chamber C1 corresponds to C1L and has an acoustic compliance of $11\times10^{-6}$ $m^5/N$.

Chamber C3 corresponds to C2L and has an acoustic compliance of $3.1\times10^{-6}$ $m^5/N$.

Using Equations 45 and 46 the remaining values can be defined as follows:

Duct D4 corresponds to L1H and has an acoustic mass of 22 $kg/m^4$.

Duct D5 corresponds to L2H and has an acoustic mass of 81 $kg/m^4$.

Chamber C4 corresponds to C3H and has an acoustic compliance of $57\times10^{-6}$ $m^5/N$.

Membrane C3 corresponds to C1H and has an acoustic compliance of $4.7\times10^{-6}$ m/N.

Membrane C5 corresponds to C2H and has an acoustic compliance of $9.4\times10^{-6}$ m/N.

These values can be converted to physical dimensions using the conversions familiar to artisans in the acoustic domain. For example, assuming an air density ($\rho_0$) of 1.18 $kg/m^3$ and speed of sound in air (c) of 345 m/S, the length to cross sectional area ratios of the ducts in SI units will be acoustic mass divided by 1.18. Assuming a duct diameter of 200 mm the length of ducts will be as follows: Duct D1 1.4 m, duct D2 120 mm, duct D3 710 mm, duct D4 600 mm, duct D5 2.1 m. The chamber volumes will be the acoustic compliance multiplied by $\rho_0 c^2$, which works out to 1.6 $m^3$ for chamber C1, 0.44 $m^3$ for chamber C2, 1.3 $m^3$ for chamber C4. The membrane characteristics of C3 and C5 are such that the volume displaced divided by the pressure exerted on the membrane provides the values previously indicated.

Finally, it is to be understood that various alterations, modifications and/or additions may be introduced into the constructions and arrangements of parts previously described without departing from the spirit or ambit of the invention.

Appendix

Parameters for Input Impedance of Passive Fourth Order Notched Crossover Filters The input impedances $Z_{LP}$ and $Z_{HP}$ of the passive low-pass and high-pass filters and their parallel combination $Z_{IN}$ are best considered by partitioning them into parallel components of resistance $R_{LP}$, $R_{HP}$, $R_{IN}$ and reactance $X_{LP}$, $X_{HP}$, $X_{IN}$, whose values are derived below $$R_{LP} = R_O\left[\frac{1-2k^2a^2+a^4}{1-k^2a^2}\right]^2 \tag{A1}$$

$$R_{LP} = R_O\left[\frac{1-2k^2a^2+a^4}{k^2a^2-a^4}\right]^2 \tag{A2}$$

where the normalised frequency variable $a=\omega T_X=f/f_X$. The expressions for the resistive components are, not surprisingly, inversely proportional to the squared magnitudes of the frequency responses of the filters, i.e. to the power that they absorb from the input. The resistive component of their parallel combination is $$R_{LP} = R_O\frac{(1-2k^2a^2+a^4)^2}{1-2k^2a^2+2k^4a^4-2k^2a^6+a^8} \tag{A3}$$

These are shown in the solid curves of FIG. 14. The reactive components, shown in the dashed curves of FIG. 14, are $$X_{LP} = \frac{4\sqrt{(2-2k^2)}R_O(1-2k^2a^2+a^4)^2}{(5-7k^2)a+(7-11k^2+10k^4)a^3+(1-13k^2+6k^4)a^5+(3-k^2)a^7} \tag{A4}$$

$$X_{HP} = \frac{4\sqrt{(2-2k^2)}R_O(1-2k^2a^2+a^4)^2}{(3-k^2)a+(1-13k^2+6k^4)a^3+(7-11k^2+10k^4)a^5+(5-7k^2)a^7} \tag{A5}$$

While $X_{LP}$ is positive at all frequencies, $X_{HP}$ is negative at all frequencies. Thus, because the y axis of FIG. 14 must be plotted on a logarithmic scale to accommodate the great variations in magnitude, $X_{HP}$ is plotted there as $-X_{HP}$.

$$X_{IN} = \frac{2\sqrt{(2-2k^2)R_O(1-2k^2a^2+a^4)^2}}{(1-3k^2)(a-a^7)+(3+k^2+2k^4)(a^3-a^5)} \quad \text{(A6)}$$

Because $X_{IN}$ is positive at all frequencies below $f_X$, and negative at all frequencies above $f_X$, it is plotted in FIG. 14 as its magnitude $|X_{IN}|$. The combined input impedance $Z_{IN}$ is less than $R_{IN}$ by so small a margin that its plot would have needlessly cluttered FIG. 14. It is therefore omitted.

What is claimed is:

1. An improved filter system including a low pass filter having a response which rolls off towards a crossover frequency and a high pass filter having a complementary response which rolls off towards said crossover frequency such that the combined response of said filters is substantially constant in amplitude at least in the region of said crossover frequency, wherein said response of said low pass filter is defined by a low pass complex transfer function having a first numerator and a first denominator and said response of said high pass filter is defined by a high pass complex transfer function having a second numerator and a second denominator and wherein said second denominator is substantially the same as said first denominator and the sum of said first and second numerators has substantially the same squared modulus as said first or second denominator.

2. An improved filter system according to claim 1 wherein said low pass filter includes a first null response at a frequency adjacent and above said crossover frequency to provide initial rapid attenuation and said high pass filter includes a second null response at a frequency adjacent and below said crossover frequency.

3. An improved filter system according to claim 2 wherein said first null response is provided by at least one complex conjugate pair of transmission zeros such that their imaginary parts lie in the stop band of said low pass transfer function within the crossover region and said second null response is provided by at least one complex conjugate pair of transmission zeros such that their imaginary parts lie in the stop band of said high pass transfer function within the crossover region.

4. An improved filter system according to claim 1 when used as a crossover filter for signals in an electrical domain.

5. A loudspeaker system including an improved filter system according to claim 4.

6. An improved filter system according to claim 1 when used as a crossover filter in an electromagnetic domain.

7. An improved filter system according to claim 1 when used as a crossover filter in an optical domain.

8. An improved filter system according to claim 1 when used as a crossover filter in an acoustical domain.

9. An improved filter system according to claim 1 when used as a crossover filter in a mechanical domain.

10. An improved filter system according to claim 1 when used as a crossover filter in two more domains simultaneously.

11. An improved filter system according to claim 10 wherein said domains include electrical and acoustical domains.

12. An improved filter system according to claim 10 wherein said domains include mechanical and acoustical domains.

13. An improved filter system according to claim 10 when said domains include electrical and optical domains.

14. An improved filter system according to claim 10 when said domains include electrical, mechanical and acoustical domains.

15. An improved filter system according to claim 1 wherein said low and high pass filters include passive filters.

16. An improved filter system according to claim 1 wherein said low and high pass filters include active filters.

17. An improved filter system according to claim 1 wherein said low and high pass filters include analog filters.

18. An improved filter system according to claim 1 wherein said low and high pass filters include digitally implemented filters.

19. A method of tuning a filter system including a low pass filter having a response which rolls off towards a crossover frequency and a high pass filter having a complementary response which rolls off towards said crossover frequency to provide a combined amplitude response for said filters that is substantially constant at least in the region of said crossover frequency, said method including the steps of:

selecting a filter topology capable of realizing a low pass complex transfer function defined by a first numerator and a first denominator;

selecting a filter topology capable of realizing a high pass complex transfer function defined by a second numerator and a second denominator;

setting the second denominator so that it is substantially the same as the first denominator;

setting the squared modulus of the sum of the first and second numerators so that it is substantially the same as the squared modulus of the first or second denominator;

determining coefficients for said transfer functions and converting said coefficients to values of components in said filter topologies; and incorporating components having said values in said filter topologies to provide said combined amplitude response.

20. A method according to claim 19 wherein said low pass transfer function includes at least one complex conjugate pair of transmission zeros such that their imaginary parts lie in the stop band of said low pass transfer function within the crossover region to provide a null response at a frequency adjacent and above said crossover frequency and said high pass transfer function includes at least one complex transmission zero such that their imaginary parts lie in the stop band of said high pass transfer function within the crossover region to provide a null response at a frequency adjacent and below said crossover frequency.

21. A method according to claim 19 wherein said filter system is used as a crossover filter for signals in an electrical domain.

22. A method according to claim 19 wherein said filter system is used as a crossover filter in an electromagnetic domain.

23. A method according to claim 19 wherein said filter system is used as a crossover filter in an optical domain.

24. A method according to claim 19 wherein said filter system is used as a crossover filter in an acoustical domain.

25. A method according to claim 19 wherein said filter system is used as a crossover filter in a mechanical domain.

26. A method according to claim 19 wherein said filter system is used as a crossover filter in two more domains simultaneously.

27. A method according to claim 19 wherein said domains include electrical and acoustical domains.

28. A method according to claim 19 wherein said domains include mechanical and acoustical domains.

29. A method according to claim 19 wherein said domains include electrical and optical domains.

30. A method according to claim 19 wherein said domains include electrical, mechanical and acoustical domains.

31. A method according to claim 19 wherein said low and high pass filter include passive filters.

32. A method according to claim 19 wherein said low and high pass filters include active filters.

33. A method according to claim 19 wherein said low and high pass filters include analog filters.

34. A method according to claim 19 wherein said low and high pass filters include digitally implemented filters.

* * * * *